US006251169B1

(12) United States Patent
Shimomura et al.

(10) Patent No.: US 6,251,169 B1
(45) Date of Patent: Jun. 26, 2001

(54) METHOD FOR VACUUM/REDUCED-PRESSURE REFINING AND FACILITY FOR VACUUM/REDUCED-PRESSURE REFINING

(75) Inventors: Kensuke Shimomura; Masaru Sadachika, both of Futtsu; Hironori Takano, Hikari; Gaku Ogawa, Hikari; Kenji Abe, Hikari; Mayumi Okimori, Hikari; Nobuyuki Makino, Hikari; Hiroshi Iwasaki, Hikari; Tomoaki Tanaka, Hikari; Hiroaki Morishige, Hikari, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/125,733

(22) PCT Filed: Dec. 25, 1997

(86) PCT No.: PCT/JP97/04823

§ 371 Date: Mar. 8, 1999

§ 102(e) Date: Mar. 8, 1999

(87) PCT Pub. No.: WO98/29575

PCT Pub. Date: Jul. 9, 1998

(30) Foreign Application Priority Data

| | | |
|---|---|---|
| Dec. 25, 1996 | (JP) | 8-355888 |
| Jan. 21, 1997 | (JP) | 9-020924 |
| Feb. 7, 1997 | (JP) | 9-038541 |
| Feb. 7, 1997 | (JP) | 9-038542 |

(51) Int. Cl.[7] ..... B01D 46/02

(52) U.S. Cl. ..... 95/284; 55/341.1; 55/417; 55/418; 55/431; 55/432; 55/467; 96/379; 96/399

(58) Field of Search ..... 45/284; 96/372, 96/379, 399; 55/417, 418, 420, 467, 428, 429, 431, 432, 341.1

(56) References Cited

U.S. PATENT DOCUMENTS

| | | | | |
|---|---|---|---|---|
| 2,792,074 | * | 5/1957 | Schlib et al. | 96/372 |
| 3,325,979 | * | 6/1967 | Smith | 44/418 |
| 3,380,780 | * | 4/1968 | Allen et al. | 55/432 |
| 3,395,512 | * | 8/1968 | Finney, Jr. et al. | 96/372 |
| 3,617,043 | * | 11/1971 | Hirao | 95/284 |
| 3,813,853 | * | 6/1974 | Anderson | 55/431 |
| 4,205,931 | * | 6/1980 | Singer et al. | 55/431 |
| 4,378,979 | * | 4/1983 | Dunseith | 96/379 |
| 4,637,473 | * | 1/1987 | Gillis et al. | 55/432 |
| 5,053,063 | * | 10/1991 | Sisk | 55/429 |
| 6,036,751 | * | 3/2000 | Ribardi et al. | 55/419 |

FOREIGN PATENT DOCUMENTS

| | | |
|---|---|---|
| 12 25 679 | 9/1966 | (DE) . |
| 59-157466 | 10/1984 | (JP) . |
| 5-192524 | 8/1993 | (JP) . |
| 6-17115 | 1/1994 | (JP) . |
| 8-3627 | 1/1996 | (JP) . |

* cited by examiner

*Primary Examiner*—Duane S. Smith
(74) *Attorney, Agent, or Firm*—Wenderoth, Lind & Ponack, L.L.P.

(57) ABSTRACT

A vacuum/reduced pressure refining vessel (1) is connected, by an upstream duct (5) to a dry dust collector (3) that uses a filter (2). The dry dust collector (3) is connected to a reduced pressure evacuating apparatus (4) by a downstream duct (6), and a block valve (7) is provided in the upstream duct (5). At the start of a vacuum/reduced pressure refining treatment, a non-oxidizing gas is injected into the upstream duct at a position that is upstream of the block valve (7) to substantially replace the oxygen in the upstream duct and to hermetically close the upstream duct. After the hermetically closed state has been established in the upstream duct, the block valve (7) is opened and operation of the dry dust collector (3) is started. At the end of the vacuum/reduced pressure refining treatment, the block valve (7) is closed and only the non-oxidizing gas is injected into the upstream duct to return the pressure, and then the upstream duct is opened to atmospheric air, and preferably an open port on the side of the dry dust collector (3) is closed during a waiting period from the end of the vacuum/reduced pressure refining treatment until the start of the next vacuum/reduced pressure refining treatment.

32 Claims, 11 Drawing Sheets

METHOD FOR VACUUM/REDUCED-PRESSURE REFINING AND FACILITY FOR VACUUM/REDUCED-PRESSURE REFINING

BACKGROUND OF THE INVENTION

1. Technical Field

The present invention relates to a vacuum/reduced pressure refining process and a vacuum/reduced pressure refining facility for use in metal refining, i.e. refining of alloys such as steel, etc., e.g. molten metal, etc. in a vacuum/reduced pressure converter, a degassing apparatus for a vacuum ladle, etc.

2. Description of Related Art

In continuous operation of vacuum/reduced pressure refining treatment under a subatmospheric pressure, the following steps are repeatedly carried out in series to exchange the treated molten metal in the refining vessel with an untreated molten metal.

That is, in case of a vacuum/reduced pressure refining apparatus of such a model as shown in FIG. 8, at first molten metal 13 is charged into a refining vessel 1, followed by closing the vessel with a lid 14 and reducing the inside pressure of the refining vessel to vacuum/reduced pressure. In case of a vacuum/reduced pressure refining apparatus, as shown in FIG. 9, a ladle 17 containing the molten metal is placed in a refining vessel 1, followed by closing the vessel with a lid 14 and reducing the inside pressure of the refining vessel to vacuum/reduced pressure. In the case of a vacuum/reduced pressure refining apparatus, as shown in FIG. 10, a ladle 17 containing molten metal 13 is positioned on a ladle elevating device 18 under a refining vessel 1, followed by dipping the lower end 19 of the refining vessel 1 into the molten metal and reducing the inside pressure of the refining vessel to a vacuum/reduced pressure. After the vacuum/reduced pressure treatment, the inside pressure of the vacuum/reduced pressure refining vessel is returned to atmospheric pressure, followed by removing the lid from the refining vessel to open the vessel or by removing the lower end of the refining vessel from the molten metal in the ladle. Then, the treated molten metal is discharged from the refining vessel, or the ladle is taken out. The period from the end of these operations to the start of the next treatment is a waiting period.

Use of a filter-type dust collector in a vacuum evacuating apparatus is known, for example, from JP-A-617115. In such a system the dust collector must be connected to a vacuum/reduced pressure refining vessel and used in a hermetically closed state during the vacuum/reduced pressure refining treatment, and thus there is no suction of excess air therein during the treatment. When dust in an unoxidized metallic state is generated in the vacuum/reduced pressure refining vessel, the dust reaches the dust collector, while maintaining the unoxidized state. As a result, when air invades the dust collector for reasons such as pressure returning to the atmospheric pressure by air, etc., the metal dust deposited on the filter react with the air, thereby causing the problems of oxidation/heat generation. As a result, in the case of filter cloth being used for a filter, the filter cloth is damaged by heat or completely burnt in serious cases. In the case of ceramics being used for a filter, the filter itself undergoes no direct damage by heat, but the collected dust is sintered to cause clogging in the filter meshes or impair the filterability of the filter due to solidification on the filter.

To solve these problems, JP-A-8-3627 discloses that, in the case that combustible substances are contained in the dust, the dust collector must be subjected to pressure returning or back washing with an argon gas or a nitrogen gas to prevent the filter from being damaged by the air introduced at the time of pressure returning after the vacuum degassing treatment of treated molten metal.

Problems to be Solved by the Invention

1) The problem of filter damage at the time of pressure returning to the atmospheric pressure just after the vacuum/reduced pressure treatment can be solved by the above-mentioned measures, but any such measures have not been so far applied until the start of the next treatment, etc. That is, even if back washing with an argon gas, a nitrogen gas or the like is carried out after the treatment, all of the dust captured on the filter cannot be separated and cannot fall down, and a portion of the dust may still remain attached to the filter until the start of the next treatment. In the case where the remaining dust contains unoxidized fine powders of metal of high oxygen affinity such as magnesium, etc., we have another problem of filter damage at the start of the next treatment, even if the pressure returning with an argon gas, a nitrogen gas or the like is carried out.

Specifically, filter damage as a result of suction of a large amount of air from the open connection port at an upstream side (refining vessel) of the dust collector into the dust collector at the start of vacuum/reduced pressure refining treatment, for example, from the open port of an expansion joint unconnected to the refining vessel, the open port of the refining vessel out of lid engagement, the lower ends of RH dipping pipes, etc. occurs, for example, when reduced pressure evacuating apparatus 4 is to be started before expansion joint 9 is connected, as in the case of a vacuum/reduced pressure refining facility having expansion joint 9 between vacuum lid 14 and upstream duct 5, as shown in FIG. 4, or when reduced pressure evacuating apparatus 4 is to be started before vacuum lid 14 is completely engaged in a vacuum,/reduced pressure refining facility as shown in FIG. 9, or when reduced pressure evacuating apparatus 4 is to be started before suction pipes 19 are dipped into molten metal 13 by elevating ladle 17 by elevating device 18 in the vacuum/reduced pressure refining facility, as shown in FIG. 10.

Furthermore, when the refined molten metal is to be exchanged with untreated molten metal during the operation of vacuum/reduced pressure treatment, the process of returning the pressure to atmospheric pressure is carried out, and then the lid is released from the refining vessel or the bottom end of the vessel is released from the molten metal to exchange molten metals. During the exchangement or the waiting period between one treatment and another, atmospheric air invades the refining vessel and duct 5 connecting the refining vessel to the dust collector is open to the atmosphere. A simplified duct is shown in FIG. 4, etc., but actually a gas cooler, a cyclone separator, etc. (not shown in the drawings) are provided in the duct. That is, the actual duct often has a large net capacity. Thus, at an initial stage of the treatment, not only the air introduced from the outside by suction, but also the air remaining in the duct extending from the dust collector to the refining vessel is led to the dust collector to oxidize the remaining dust on the filter to generate heat and damage the filter in some cases.

2) Thus far, no measures have been taken to prevent filter cloth from being damaged due to oxidation of dust deposited on the filter cloth or to prevent ceramic filter from clogging, or to o prevent the apparatus from damage and dust discharge trouble due to oxidation or sintering of dust accumulated in the lower part of the dust collector through separation and falling down, caused by suction of atmospheric air from the dust discharge port during the vacuum/reduced pressure treatment. That is, vacuum sealing is carried out by providing a valve, a lid or the like for vacuum sealing at the dust discharge port, but its sealability is likely to deteriorate due to the dust, and leakage is more likely to occur than at other positions of the vacuum/reduced pressure refining facility. When the degree of leakage is considerably high, the filter is damaged by the oxygen in the introduced air by suction during the vacuum/reduced pressure treatment. Even if the degree of leakage is not high enough to directly damage the filter, the dust accumulated at the lower part of the dust collector through separation and falling down is oxidized by the oxygen to generate heat and causes problems such as vacuum seal damage and discharge trouble due to dust sintering, etc.

3) Any industrial process for stably discharging dust in an unoxidized metallic state of high reactivity with oxygen, as mentioned above, from the dust discharge outlet during the off period from the vacuum/reduced pressure treatment has not yet been developed. That is, even if the process of returning the pressure is carried out with a non-oxidizing gas after the vacuum/reduced pressure treatment, some troubles are caused if the atmospheric air is introduced into the dust collector at the time of discharging dust from the dust collector. And, once the atmospheric air is introduced into the dust collector from the dust discharge outlet during the successive period of discharging the dust once collected on the filter and then separated to fall down from the filter to the outside of the dust collector, the remaining dust deposited on the filter is oxidized to cause heat damage, when filter cloth is used as a filter, and cause dust sintering and clogging when ceramics are used as a filter, thereby adversely affecting the functions of the dust collector. Furthermore, oxidation and heat generation of the dust by the atmospheric air, near the dust discharge outlet or in the course of discharging, cause heat damage of devices near the outlet such as vacuum seal packings, etc. or discharge trouble due to reduced flowability of the dust caused by sintering or coagulation of agglomeration of the dust.

4) Thus far, no measures have been taken to prevent suction of atmospheric air, etc. during the period from the pressure returning process to the start of the next treatment. That is, unless air invasion into the dust collector by leakage, etc. is prevented after the pressure returning process, the filterability of the filter is deteriorated by air oxidation of the remaining dust, and the remaining dust undergoes reaction and sintering, thereby causing such problems as trouble with the next discharging operation.

SUMMARY OF THE INVENTION

The present vacuum/reduced pressure refining process is as follows:

(1) A vacuum/reduced pressure refining process using a vacuum/reduced pressure refining facility comprising a vacuum/reduced pressure refining vessel, a dry dust collector using a filter, a reduced pressure evacuating apparatus and ducts successively connecting the apparatuses. A freely opening/closing block valve is provided in an upstream duct for connecting the vacuum/reduced pressure refining vessel to the dust collector and a connection port is provided in the duct further upstream of the block valve in the upstream duct or in a hermetically-to-be closed space including the refining vessel. The connection port is closed at the start of vacuum/reduced pressure refining treatment and the block valve upstream of the dust collector is opened after the atmosphere is brought into a hermetically closed state in the upstream duct from the vacuum/reduced pressure refining vessel to the block valve provided in the upstream duct near the vacuum/reduced pressure refining vessel to operate the dust collector.

(2) A vacuum/reduced pressure refining process as described in item (1), characterized by injecting a non-oxidizing gas into the upstream duct at the nearer side to the vacuum/reduced pressure refining vessel than the block valve provided in the upstream duct at the start of vacuum/reduced pressure refining treatment and closing the connection port provided in the upstream duct after substantial replacement of the oxygen in the upstream duct.

(3) A vacuum/reduced pressure refining process as described in items (1) or (2), characterized by closing the block valve provided in the upstream duct before opening the connection port provided in the upstream duct at the end of vacuum/reduced pressure refining treatment and returning the pressure of the atmosphere in the upstream duct at the nearer side to the vacuum/reduced pressure refining vessel than the block valve only by injection of the non-oxidizing gas therein.

(4) A vacuum/reduced pressure refining process as described in item (3), characterized by closing an open port of connection apparatus connected to the upstream duct at the nearer side to the vacuum/reduced pressure refining vessel during a waiting period from the end of vacuum/reduced pressure refining treatment to the start of next treatment.

(5) A vacuum/reduced pressure refining process using a vacuum/reduced pressure refining facility comprising at least a vacuum/reduced pressure refining furnace, a dry type dust collector using a filter and an evacuating apparatus, characterized by sealing the outside of a vacuum seal valve or a vacuum seal lid at a dust discharge port at the bottom of the dry type dust collector with a non-oxidizing gas during a vacuum evacuating period for operating the dry type dust collector.

(6) A vacuum/reduced pressure refining process using a vacuum/reduced pressure refining facility comprising at least a vacuum/reduced pressure refining furnace, a dry type dust collector using a filter and having a freely opening/closing dust discharge outlet at the bottom, an evacuating apparatus, and a piping and an opening/closing valve for introducing a non-oxidizing gas into the dust collector, characterized by introducing the non-oxidizing gas into the dust collector so as to allow the nonoxidizing gas to flow out of the dust discharge outlet when dusts are to be discharged from the dust discharge outlet during an off-period from the vacuum/reduced pressure treatment.

(7) A vacuum/reduced pressure refining process using a vacuum/reduced pressure refining facility comprising at least a vacuum/reduced pressure refining furnace, a dry type dust collector using a filter and having a freely opening/closing dust discharge outlet at the bottom and an evacuating apparatus, characterized by keeping the outside of the dust discharge outlet in a non-oxidizing gas atmosphere when dusts are to be discharged from the dust discharge outlet during an off-period of the vacuum/reduced pressure treatment.

(8) A vacuum/reduced pressure refining process using a vacuum/reduced pressure refining facility comprising at least a vacuum/reduced pressure refining furnace, a dry type dust collector using a filter and having a freely opening/closing dust discharge outlet at the bottom, an evacuating apparatus, and a piping and an opening/closing valve for introducing a non-oxidizing gas into the dust collector, characterized by introducing the non-oxidizing gas into the dust collector so as to allow the non-oxidizing gas to flow out of the dust discharge outlet and keeping the outside of the dust discharge outlet in a non-oxidizing gas atmosphere at the same time, when dusts are to be discharged from the dust discharge outlet during an off-period from the vacuum/reduced pressure treatment.

(9) A vacuum/reduced pressure refining process using a vacuum/reduced pressure refining facility comprising a vacuum/reduced pressure refining vessel, a dry type dust collector using a filter, a reduced pressure evacuating apparatus and ducts connecting said apparatuses successively, characterized by injecting a non-oxidizing gas into the dry type dust collector so as to keep a superatmospheric pressure in the dry type dust collector during a waiting period free from operation of the dry type dust collector from the time of completion of pressure returning by closing a freely opening/closing block valve provided in an upstream duct connecting the vacuum/reduced pressure refining vessel to the dry type dust collector and another freely opening/closing block valve provided in a downstream duct connecting the dry type dust collector to the reduced pressure evacuating apparatus at the same time to the start of next operation.

The present vacuum/reduced pressure refining facility is constructed as follows:

(10) A vacuum/reduced pressure refining facility, which comprises a vacuum/reduced pressure refining vessel, a dry type dust collector using a filter, a reduced pressure evacuating apparatus, and ducts connecting these apparatuses successively. An opening/closing block valve is provided in an upstream duct connecting the vacuum/reduced pressure refining vessel to the dust collector. The facility is characterized in that a piping or pipe and an associated opening/closing valve is provided for the purpose of introducing a non-oxidizing gas into the upstream duct, which is disposed on the side of the vacuum/reduced pressure refining vessel, and upstream of the block valve provided in the upstream duct and at the upstream side near the vacuum/reduced pressure refining vessel.

(11) A vacuum/reduced pressure refining apparatus, which comprises a vacuum/reduced pressure refining vessel, a dry type dust collector using a filter, a reduced pressure evacuating apparatus and ducts connecting said apparatuses successively. A freely opening/closing block valve is provided in an upstream duct connecting the vacuum/reduced pressure refining vessel to the dust collector. The apparatus is characterized by a detachable seal lid for the port of a dust collector-side duct at an open port siding with the refining vessel and existing upstream of the block valve in the upstream duct.

(12) A vacuum/reduced pressure refining facility, which comprises at least a vacuum/reduced pressure refining furnace, a dry type dust collector using a filter and an evacuating apparatus. The facility is characterized by providing a sealing enclosure for substantially shutting off atmospheric air at the outside of a freely opening/closing vacuum seal valve or vacuum seal lid at a dust discharge port provided at the bottom of the dry type dust collector and providing a piping and an opening/closing valve for introducing a non-oxidizing gas into the sealing enclosure and a freely, opening/closing door for discharging dust from the sealing enclosure.

(13) A vacuum/reduced pressure refining facility, which comprises at least a vacuum/reduced pressure refining furnace, a dry type duct collector using a filter and an evacuating apparatus. The facility is characterized by providing a space between a freely opening/closing vacuum seal valve or vacuum seal lid at a dust discharge outlet provided at the bottom of the dry type dust collector and a dust discharge auxiliary apparatus below the vacuum seal valve or vacuum seal lid in a hermetically closed structure shutting off the atmospheric air and providing in the hermetically closed space a piping and an opening/closing valve for introducing a non-oxidizing gas therein.

(14) A vacuum/reduced pressure refining facility, which comprises at least a vacuum/reduced pressure refining vessel, a dry type dust collector using a filter and having a freely opening/closing dust discharge outlet at the bottom and an evacuating apparatus. The facility is characterized by hermetically connecting a transport piping to the outside of the dust discharge outlet to pneumatically transport discharged dust, providing a supply piping connected to the transport piping to introduce a non-oxidizing gas for pneumatically transporting the discharged dust, and providing a device in a heat-resistant structure or a cooling structure or a dust-coolable structure at a discharge position of the transport piping.

(15) A vacuum/reduced pressure refining facility, which comprises a vacuum/reduced pressure refining vessel, a dry type dust collector using a filter, a reduced pressure evacuating appratus and ducts connecting the apparatuses successively. The facility is characterized by providing the dry type dust collector with a non-oxidizing gas injection piping having a freely opening/closing valve with a non-electrically/non-pneumatically opening function and a flow rate control valve, and further with a safety valve openable when the inside pressure of the dry type dust collector reaches a superatmospheric pressure, beside a gas-introducing piping for returning pressure by closing both a freely opening/closing block valve in an upstream duct connecting the vacuum/reduced pressure refining vessel to the dry type dust collector and a freely opening/closing block valve in a downstream duct connecting the dry type dust collector to the reduced pressure evacuating apparatus.

DETAILED DESCRIPTION OF THE INVENTION

Figure 1:
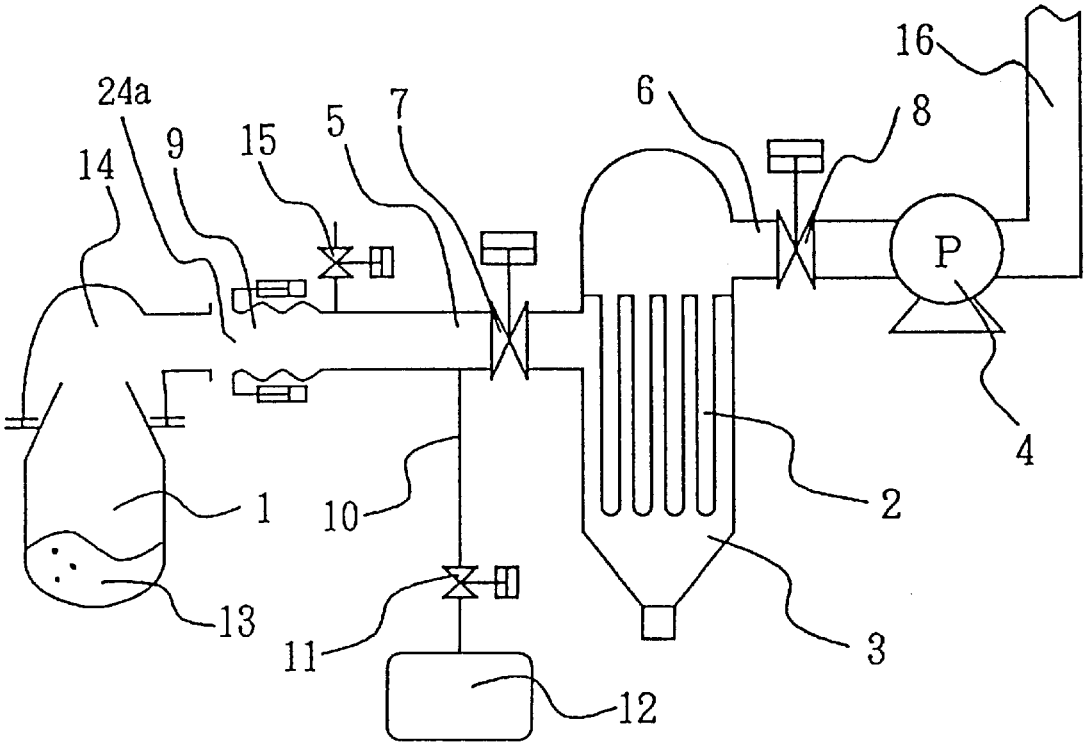
FIG. 1 is a view showing one embodiment of the present vacuum/reduced pressure refining facility.

In a first embodiment of the present invention, for an evacuating apparatus 4, as shown, for example, in FIG. 1, any type or any structure of evacuating apparatus can be used, for example, the evacuating apparatus can be an ejector or a mechanical pump, so long as it can attain pressure reduction in a refining furnace and a dry type dust collector. A vent stack 16 is connected to a downstream side of the evacuating apparatus 4.

For filter 2 in a dry type dust collector, filters of any material, for example, filter cloth or ceramics, can be used. The filter is used against all such dusts that can cause heat damage or clogging.

The term "connection port" herein used means a part of a shield enclosure wall for forming a hermetically closed space during the vacuum/reduced pressure refining period. The part is opened for some reasons during the off-period from the vacuum/reduced pressure refining period.

Figure 2:
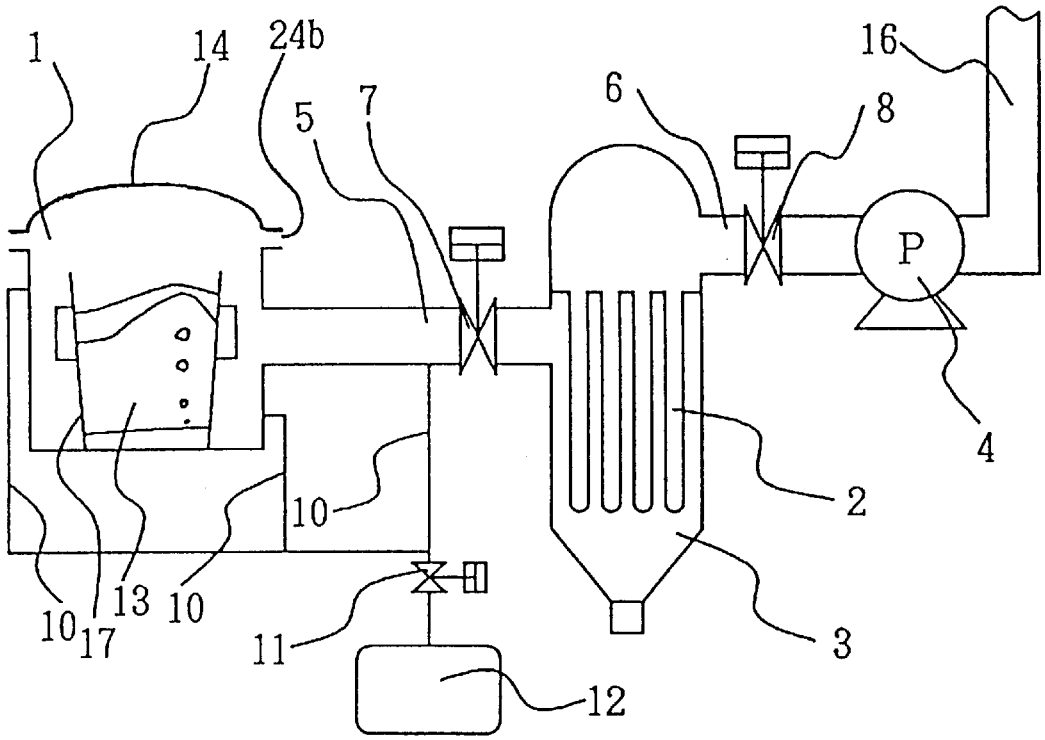
FIG. 2 is a view showing another embodiment of the present vacuum/reduced pressure refining facility.
Figure 10:
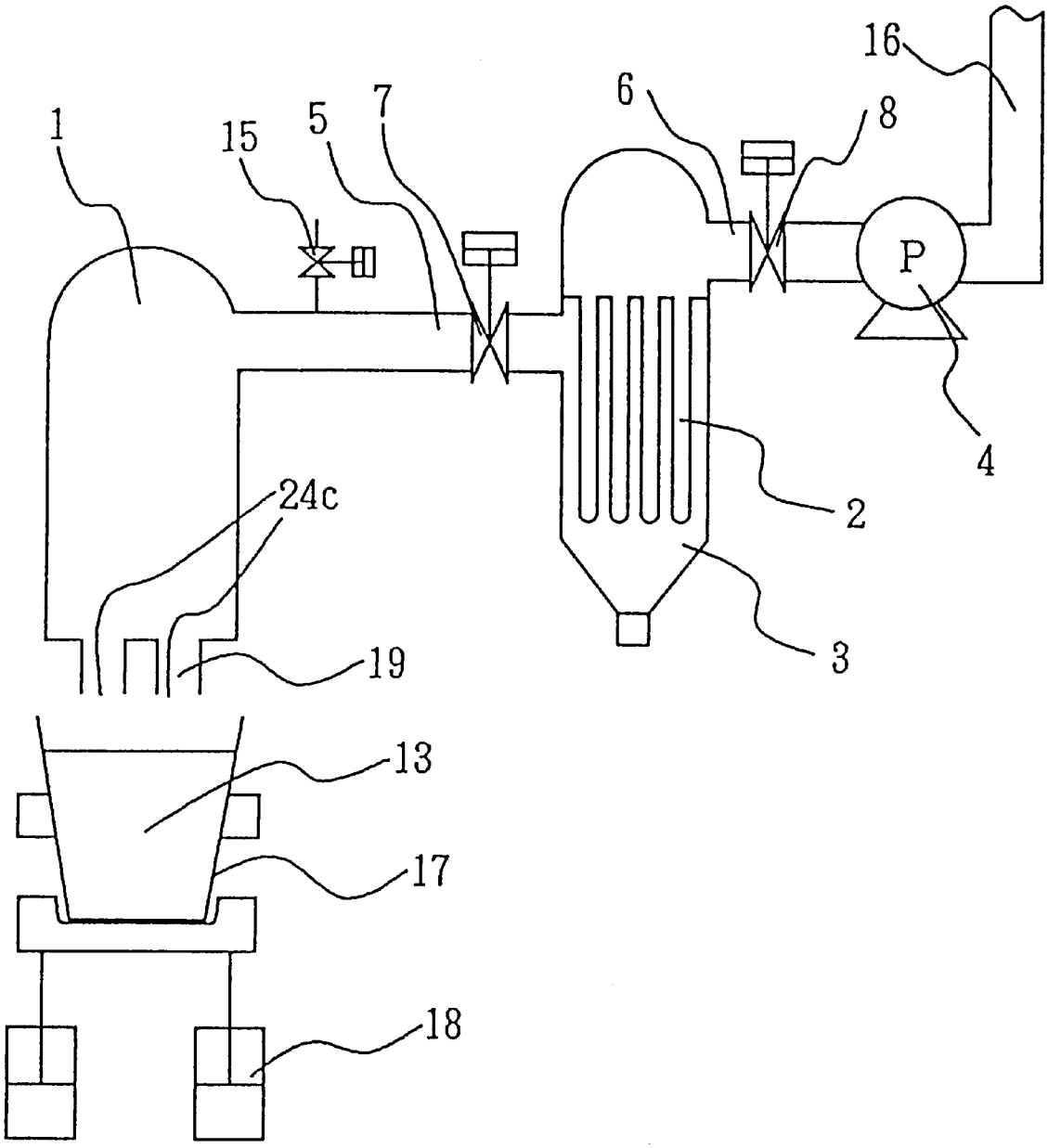
FIG. 10 (PRIOR ART)
FIG. 10 is a view showing another prior art vacuum/reduced refining facility.

Specifically, in such a vacuum/reduced pressure refining facility as shown in FIG. 1, the connection port refers to open port 24*a* of expansion joint 9, etc., which takes part in engaging or disengaging of a vacuum lid 14 with or from a refining vessel 1. In such a vacuum/reduced pressure refining facility, as shown in FIG. 2, the connection port refers to open port 24*b* of vacuum/reduced pressure refining vessel 1, which takes part in engaging or disengaging of vacuum lid 14 with or from the refining vessel 1. In such a vacuum/reduced pressure refining facility as shown in FIG. 10, the connection port refers to open port 24*c* at the lower end of a suction pipe 19.

Figure 8:
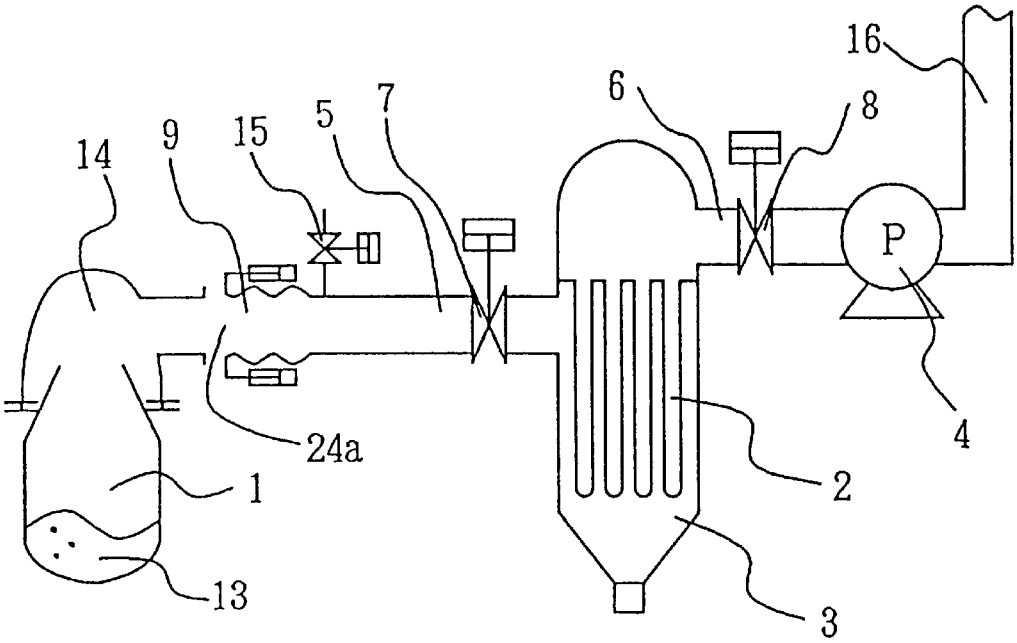
FIG. 8 (PRIOR ART)
FIG. 8 is a view showing a prior art vacuum/reduced pressure refining facility.
Figure 9:
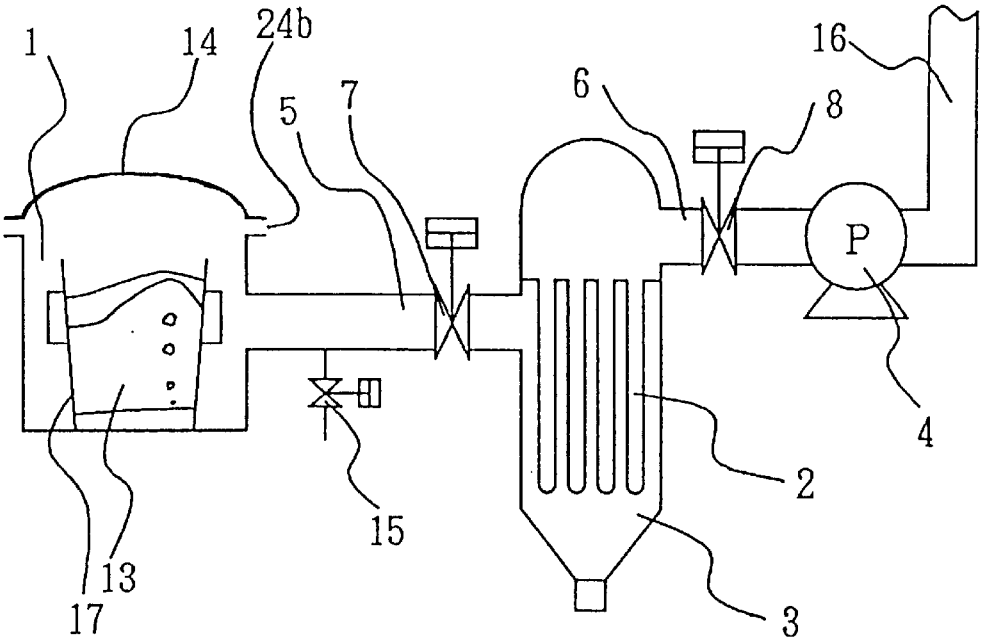
FIG. 9 (PRIOR ART)
FIG. 9 is a view showing another prior art vacuum/reduced pressure refining facility.

Closing of the connection port means, for example, connection of open port 24*a* of the expansion joint 9 with the open part of vacuum lid 14 to hermetically close the latter as shown in FIGS. 1 and 8. The vacuum lid 14 is engaged with the open part of the refining vessel 1 to hermetically close the latter, as shown in FIGS. 2 and 9. Also, the open port 24*c*, at the lower end of suction pipe 19, is dipped into molten metal as shown in FIG. 10 to hermetically close the port 24*c*. Needless to say, all other routes to the atmosphere, for example, leak valve 15, etc. must be closed beforehand.

The term "non-oxidizing gas" herein used means a gas incapable of causing an oxidation (combustion) reaction with unoxidized metallic dusts (fine powders), specifically an inert gas such as a nitrogen gas or an argon gas. In a strict sense, it does not mean only chemically inert elements, but a gas substantially incapable of causing an oxidation (combustion) reaction with unoxidized metallic dusts (fine powders). When the filter of the dust collector is made of a non-combustible material, for example, ceramics, it can include even a CO gas.

Why the term "substantially" is herein used is because the necessary upper limit oxygen concentration for preventing filter damage depends on the species, concentration, etc. of unoxidized metal elements contained in the dusts, and thus cannot be simply defined. For example, even in the case where at least 10% of fine powder dusts of metallic magnesium, metallic manganese, etc. is contained, the filter is not damaged at all, so long as the oxygen is replaced by the non-oxidizing gas in order to achieve an oxygen concentration of not more than about 2–3%.

Opening of the connection port means releasing the hermetically closed state established by closing the connection port as mentioned above, thereby exposing the connection port to the atmosphere.

"Pressure returning" is to return the interior pressure of the refining vessel, which has been reduced to less than ambient pressure, and again to substantially return the pressure to ambient atmospheric pressure, thereby establishing a facility pressure almost to such a degree so as not to produce suction of the ambient atmospheric air through clearances of the facility.

For example, a difference of about 20 to 50 Torr will not also produce suction of the ambient atmospheric air in a dust collector and operations of opening the vacuum lid and the expansion joint can be fully carried out in the vacuum lid and the expansion joint, when the atmosphere of the reduced pressure in the facility is maintained in such a manner that the ordinary vacuum seal function is performed.

Furthermore, the term "open port siding with the refining vessel and existing upstream of the block valve" is used herein to mean a cross-sectional open port of a duct, etc. when the connection port is opened.

To prevent filter damage, all of the connection ports exposed to the ambient atmosphere, which are upstream of the dust collector, must be closed to establish a hermetically closed state in the duct from the furnace to upstream of block valve 7. And, then block valve 7 can be opened to operate dust collector 3. Specifically, block valve 7, located in upstream duct 5, is to be opened, after expansion joint 9 is connected to a connection port of vacuum lid 14 in the case of FIG. 1, or after vacuum lid 14 is allowed to descend and engage with vacuum/reduced pressure refining vessel 1 in the case of FIG. 2, or after ladle 17 is allowed to ascend and suction pipe 19 is immersed in molten metal 13 in the case of FIG. 10. Closing of the connection ports to establish the hermetically closed state includes, needless to say, closing leak valve 15, the above-mentioned expansion joint, the vacuum lid, etc. In brief, it is essential to bring dust collector 3 into operation after the completely hermetically closed state has been established. The dust collector must be brought into operation by starting evacuating apparatus 4 and opening downstream block valve 8 when or before upstream block valve 7 is opened. That is, evacuating apparatus 4 must be operated before block valve 7 is opened, thereby establishing a hermetically closed state, and suction and filtration of loaded gas are carried out by opening upstream block valve 7 to bring dust collector 3 into operation.

Even if dust collector 3 is brought into operation after the hermetically closed state has been established, as mentioned above, and if the inside volume of duct 5, etc. from upstream block valve 7 to vacuum/reduced pressure refining vessel 1 is large, atmospheric oxygen remaining in duct 5 etc. can cause considerable damage to filter 2 at the initial stage of a dust collector operation.

For example, an oxygen concentration of nearly 20% sometimes prevails within the first one minute at the initial stage of dust collector operation. To prevent such a state, a piping or pipe 10 for introducing a non-oxidizing gas from a non-oxidizing gas holder 12 and an opening/closing valve 11 are provided upstream of block valve 7, as shown in FIG. 1, to inject non-oxidizing gas into duct 5 upstream of block valve 7 and thereby substantially replace the residual oxygen in duct 5, etc. with the non-oxidizing gas, and then the connection port to the ambient atmosphere is closed.

Regarding the position of injecting the non-oxidizing gas, a position with a good replacement efficiency must be selected in view of the entire structure and arrangement of the vacuum/reduced pressure refining facility. Generally, a position far from the connection port, for example, a position near block valve 7 in upstream duct 5, as shown in FIG. 1, is desirable. In the case of a large open port area, as shown in FIG. 2, it is efficient to effect the injection through a plurality of pipes or conduits 10 just before vacuum lid 14 is brought into a hermetically closed state.

The piping for introducing the non-oxidizing gas into the upstream duct sided with the furnance and upstream of the block valve in the upstream duct must be provided with an opening/closing valve capable of starting or interrupting the gas flow to inject the necessary non-oxidizing gas for substantial replacement, depending on the structure and arrangement of the vacuum/reduced pressure refining facility.

The procedure for injecting the non-oxidizing gas is not limited only to the use of special piping as mentioned above.

For example, a bottom injection type non-oxidizing gas for refining in the vacuum/reduced pressure refining vessel may be used. In the case as shown in FIG. 1, gas replacement for the duct, extending from expansion joint 9 to vacuum/reduced pressure refining vessel 1, can be efficiently carried out with the bottom-injected non-oxidizing gas in the furnace, and can likewise take other facility arrangements.

Another procedure for reducing the oxygen concentration in the air remaining in the duct, etc. upstream of block valve 7 to prevent filter damage at the initial stage of the dust collector operation is to previously replace the remaining air with a non-oxidizing gas such as a nitrogen gas, an argon gas, etc. before starting the vacuum/reduced pressure refining treatment. The most efficient timing for replacing the remaining air with the non-oxidizing gas beforehand is to utilize the pressure returning at the end of the last refining treatment. That is, before opening leak valve 15 and disengaging expansion joint 9 at the end of a vacuum/reduced pressure refining period, pressure should be returned in the duct upstream of the block valve with the non-oxidizing gas by closing block valve 7, where it is efficient to utilize piping 10 and opening/closing valve 11 for introducing the non-oxidizing gas to the duct upstream of the block valve, though the present invention is not limited only to such a piping. That is, bottom-injected stirring gas to the furnace, ladle, etc. can be used together with or as a substitute for the above-mentioned non-oxidizing gas, so long as it is also a non-oxidizing gas.

It is most efficient to utilize the timing of pressure returning, as mentioned above, for the replacement of the remaining air in the duct, etc. on the upstream side with the non-oxidizing gas, but when the waiting period for the next treatment is long, air gradually leaks into the duct through open port 24*a* of expansion joint 9, etc. to increase the oxygen concentration in the duct. To prevent the leakage, a detachable seal lid or closure 21 is provided at the joint such as expansion joint 9, etc., as shown in FIG. 3, and the seal lid 21 is closed during the waiting period from the end of pressure returning and gas replacement to the start of the next vacuum/reduced pressure refining treatment, thereby closing the open port of the duct 5 connected to the duct collector.

Figure 3:
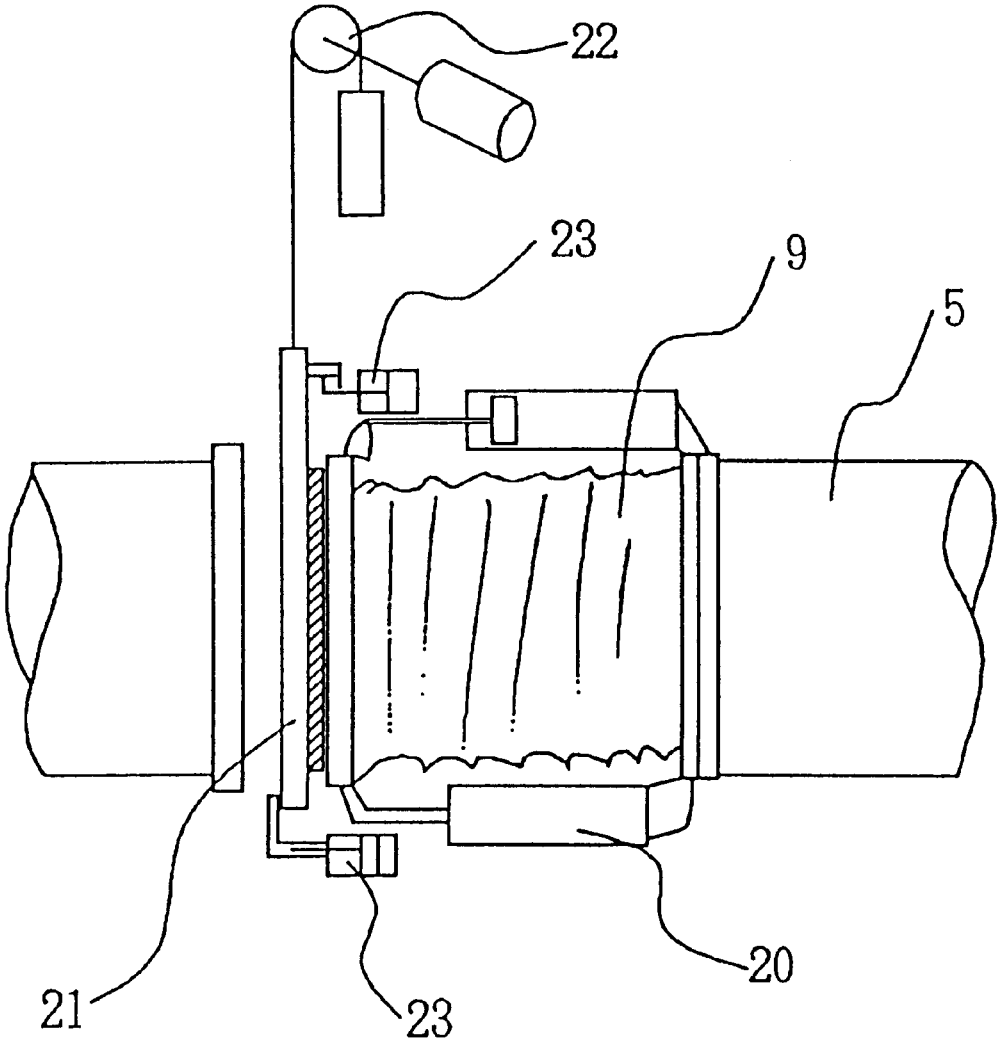
FIG. 3 is a view showing an embodiment of an expansion joint provided with a seal lid at the open port of a duct on the side of the dust collector in the present vacuum/reduced pressure refining facility.

The seal lid assembly, as shown in FIG. 3, comprises a seal lid 21, a seal lid elevating/descending means 22 and a cylinder 23 for hermetically closing the seal lid 21. After expansion joint 9 is retracted and disengaged from the connection by a cylinder 20 for releasing the expansion joint connection, seal lid 21 descends from overhead to face the open port of expansion joint 9, and then the seal lid is closely positioned relative to the open port by cylinder 23 to effect hermetical closing of the seal lid 21.

The seal lid 21 is not limited to this structure and can take other forms and arrangements, so long as it performs the function of closing the open port during the waiting period without adversely affecting the establishment of a tightly closed evacuating system during the period of vacuum/reduced pressure refining treatment.

The seal lid or closure 21 can be provided at any position that will enable substantial prevention of air invasion into duct 5, etc. with the non-oxidizing gas being introduced by replacement at the time of the pressure returning, as mentioned above. For example, in case of a vacuum/reduced pressure refining facility as shown in FIG. 2, such an appropriate position is an open port at the upper end of refining vessel 1. As a best altenative, the seal lid can be provided at the connection part between refining vessel 1 and upstream duct 5. In the case of a vacuum/reduced pressure refining facility, as shown in FIG. 10, the seal lid is provided at the lower end of suction pipes 19.

Next, description will be made below, referring to the second embodiment of the present invention.

Figure 4:
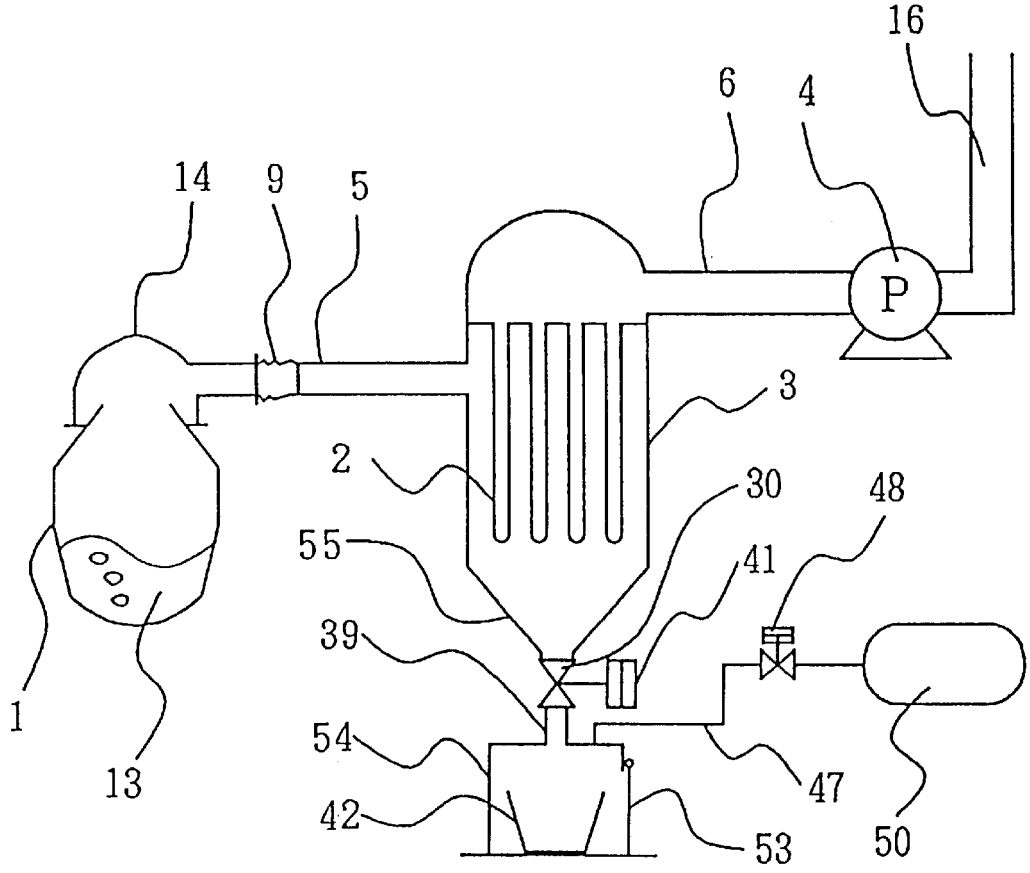
FIG. 4 is a view showing a further embodiment of the present vacuum/reduced pressure refining facility.

In the apparatus shown in FIG. 4, atmospheric air can be substantially shut off by controlling the oxygen concentration of the atmosphere in sealing enclosure 54 to a few percent by means of a gas injected through piping 47 without the necessity of providing a strictly closed space in sealing enclosure 54 in contrast to the vacuum evacuating system. The piping 47 is connected to a non-oxidizing gas holder 50 and an opening/closing valve 48 is provided in the piping 47.

"Non-oxidizing gas" has the same meaning as previously defined. "Vacuum evacuating period" means a period during which the inside of the dry type dust collector is maintained under reduced pressure below the ambient atmospheric pressure, and during this period there is the possibility that the atmospheric air will be introduced into the dry dust collector from dust discharge outlet 39 by suction.

Dust discharge outlet 39 is independent with regard to type and structure, so long as it can be vacuum sealed during the period of vacuum/reduced pressure refining treatment and can discharge dust, when required, during the off period of the vacuum treatment. Structural examples of dust discharge outlet 39 are indicated by reference numeral 39 in FIGS. 5, 11 and 12, respectively.

The basic idea of the present invention is to prevent the inside dust from oxidation and heat generation, even if there is leakage, by replacing the atmospheric air at the outside of the ready-to-leak positions with a non-oxidizing gas, since it is technically difficult to completely prevent all leakage. "Leakage" means unintended suction of atmospheric air, from the outside, which occurs at joints of a vessel, ducts, etc. for forming a vacuum space and at valves, etc. to the outside.

Sealing of particularly the dust discharge port in preference to other positions and valves of dry type dust collector such as leak valves, etc. during the period of vacuum/reduced pressure refining is carried out in order to take measures against a vacuum seal failure that would lead easily to leakage for the following two reasons. The first reason is the possibility of a hermetic seal failure, etc. due to dust intrusion into seal parts, and the second reason is the degradation of seal parts due to wear caused by high attrition of dust.

Dust falls down from the filter and is likely to accumulate around the dust discharge port, and thus, when the sealability deteriorates, the apparatus parts are easily damaged by oxidation and heat generation of the dust, such as heat deterioration of the O-ring seals. Furthermore, dust per se, once sintered so as to agglomerate by oxidation and heat generation of dust, will cause trouble with regard to dust discharging after the vacuum/reduced pressure refining treatment.

For these reasons, it is particularly necessary to seal the immediate outside of the dust discharge port with a non-oxidizing gas during the period of vacuum/reduced pressure refining treatment.

The present invention will be described in detail below, with reference to the drawings.

Figure 11:
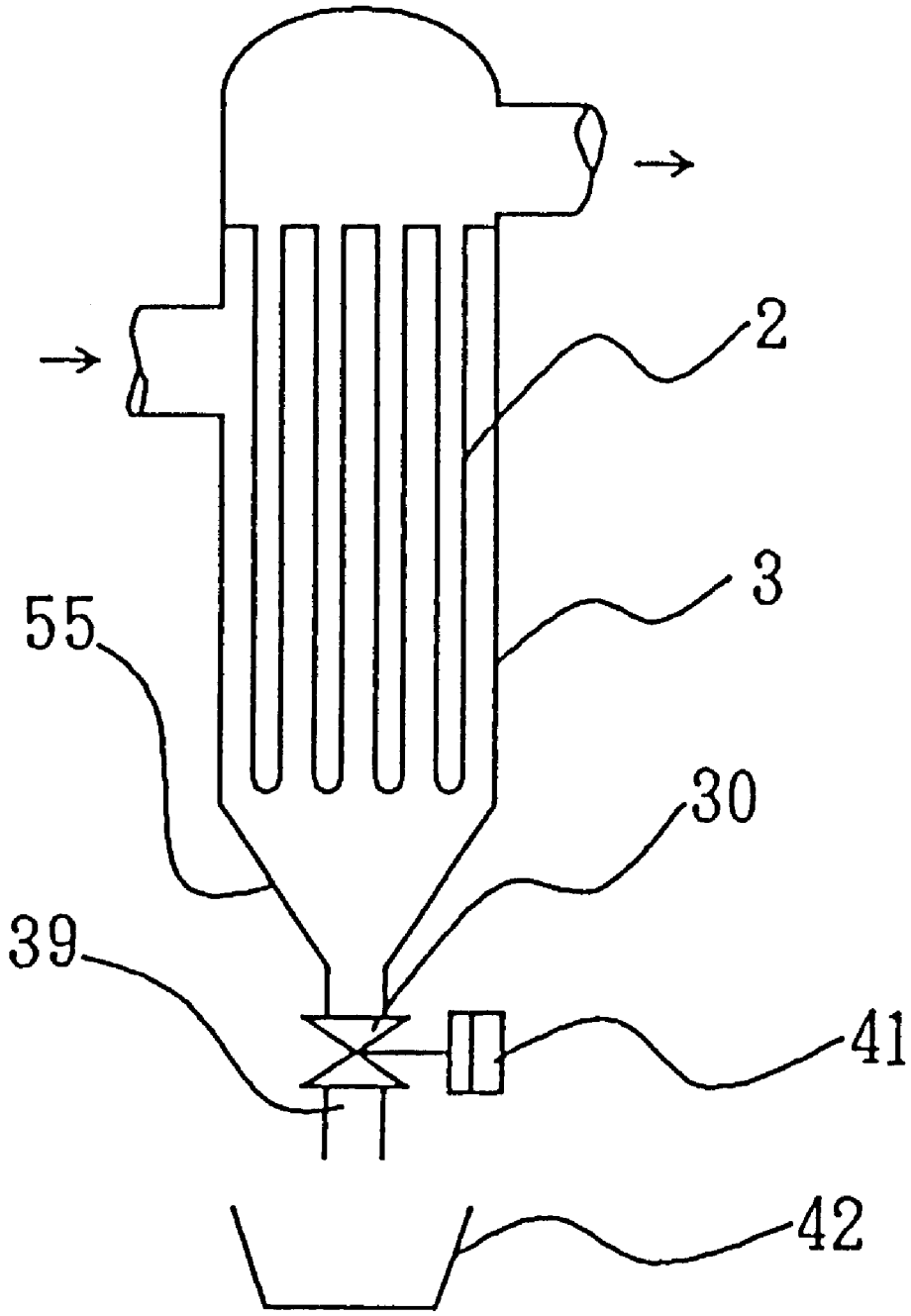
FIG. 11 is a view showing an embodiment of the structure of a dust discharge port.
Figure 12:
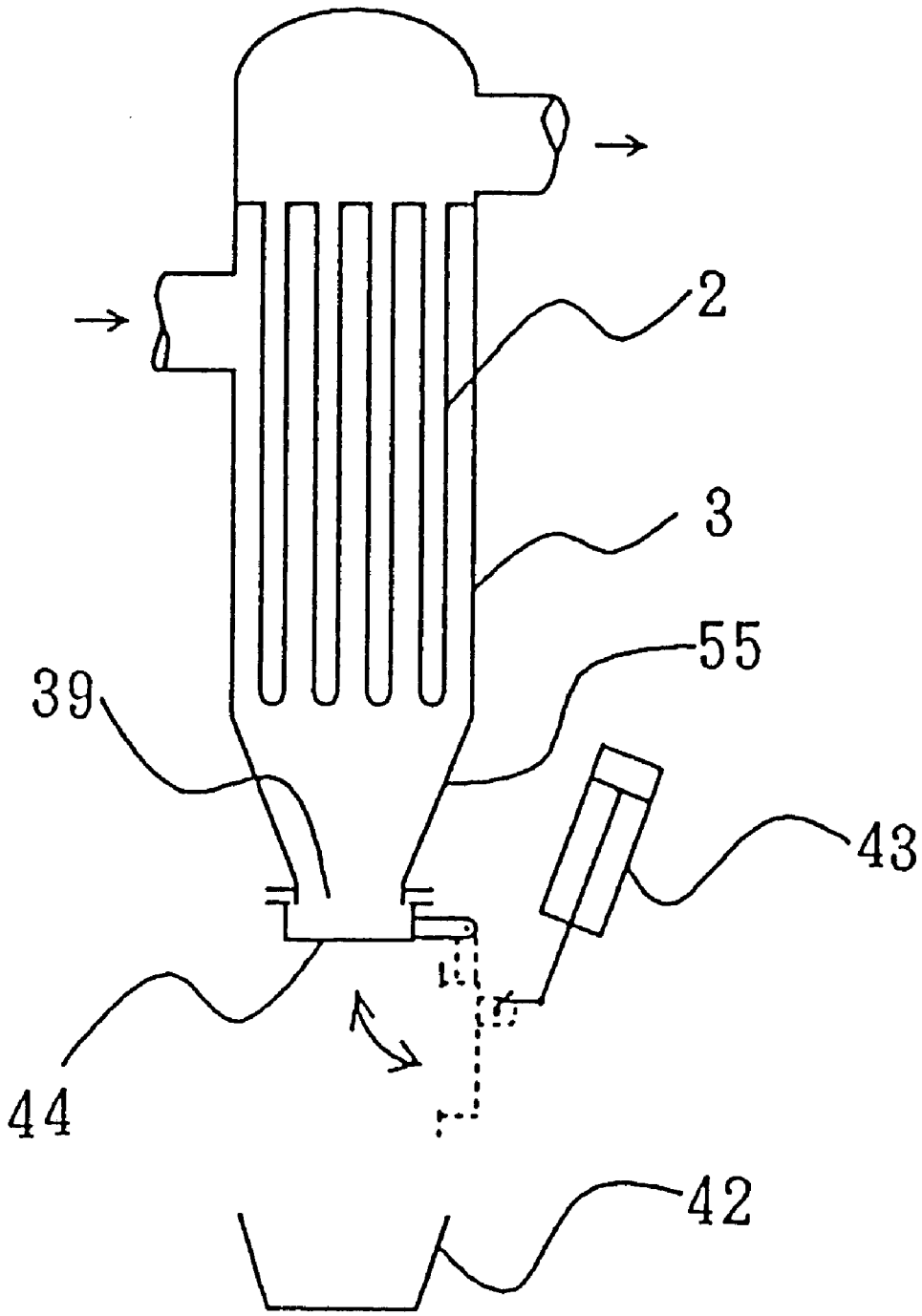
FIG. 12 is a view showing another embodiment of the structure of a dust discharge port.

FIGS. 11 and 12 show examples of a vacuum seal valve and a vacuum seal lid. Vacuum seal valve 30, which is operated by actuator 41, may be any of an ordinary vacuum ball valve, a butterfly valve, etc. and vacuum seal lid 44 is independent with regard to type and structure, so long as it can attain vacuum sealing. As shown in FIG. 12, the vacuum seal lid 44 is operated by opening/closing cylinder 43. According to the prior art, atmospheric air is present at the outside (bottom side) of vacuum seal valve 30 and vacuum seal lid 44, and once leakage occurs at the vacuum seal part, oxygen-containing air leaks in due to suction.

In the present invention, a sealing enclosure 54, as shown in FIG. 4, is provided to shut off the outside (bottom side) of vacuum seal valve 30 and vacuum seal lid from the atmospheric air. The function of dust discharge outlet 39 is to bring the dust off-line from dry type dust collector 3 and requires a door 53 that is capable of freely opening or closing for discharging dust, discharged from dust discharge outlet 39, to the outside of sealing enclosure 54.

To bring the inside of sealing enclosure 54 into a non-oxidizing gas atmosphere during the vacuum evacuating period, piping 47 is provided for introducing the non-oxidizing gas therein, and opening/closing valve 48 is required to interrupt the introduction of the non-oxidizing gas when sealing is not required during the off-period out of the treatment and the period for discharging dust from opened door 53. Without the interruption of the introduction of the non-oxidizing gas, the object of the present invention can be attained, but the above-mentioned procedures are industrially essential from the viewpoint of cost.

Figure 5:
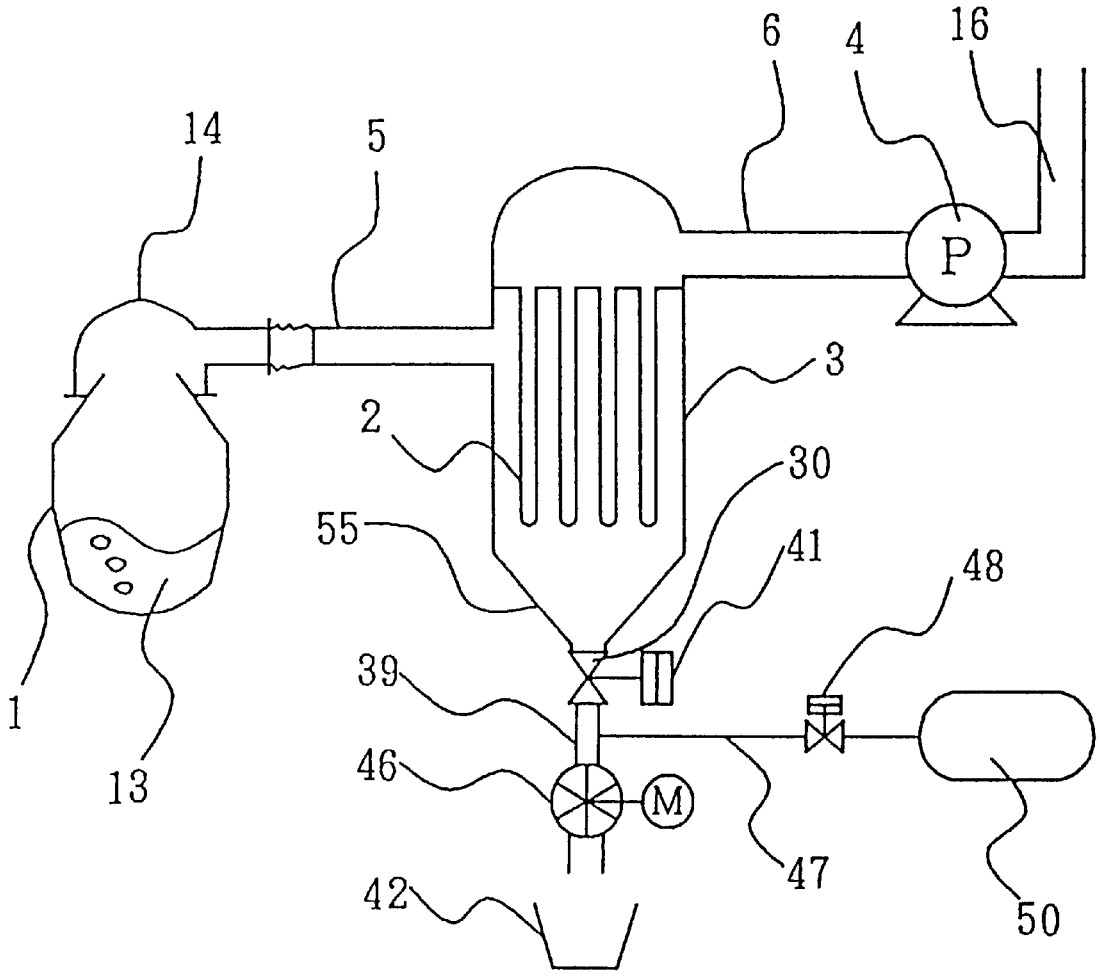
FIG. 5 is a view showing a still further embodiment of the present vacuum/reduced pressure refining facility, which is an embodiment of a vacuum/reduced pressure refining facility for carrying out the present vacuum/reduced pressure refining process B.

FIG. 5 shows an example of providing a rotary valve 46 as an auxiliary apparatus for discharging dusts. In a broad sense "auxiliary apparatus for discharging dusts" means an auxiliary apparatus for discharging dust, which may include a screw conveyer, etc. besides the rotary valve. That is, the auxiliary apparatus for discharging dust generally refers to apparatuses without any vacuum seal, as provided to adjust a discharge rate to an appropriate one for successive dust transport by pneumatic conveying, etc.

Heretofore, there has been neither a means or apparatus for introducing the non-oxidizing gas in a space between vacuum seal valve 30, etc. and the auxiliary apparatus for discharging dust. In the present invention, a space between vacuum seal valve 30, etc. and the auxiliary apparatus for discharging dust is utilized as a substitute for the sealing enclosure, and the non-oxidizing gas is likewise introduced therein to replace or maintain the outside atmosphere around vacuum seal valve 30, etc. with or in a non-oxidizing gas during the vacuum evacuating period.

It is an object of the present vacuum/reduced pressure refining process to seal the outside of the vacuum seal valve or vacuum seal lid at the dust discharge outlet at the bottom of the dry type dust collector with a non-oxidizing gas during the vacuum evacuating period for operating the dry type dust collector by means of the present vacuum/reduced pressure refining facility.

Next, the present invention will be described below, with reference to the third embodiment of the present invention.

The present vacuum/reduced pressure refining facility, which comprises at least a vacuum/reduced pressure refining furnace, a dry type dust collector with a filter and a freely opening/closing dust discharge outlet provided at the bottom, and an evacuating means, is characterized in that a transport pipe or conduit for pneumatically transporting discharged dust is hermetically connected to the outside of the dust discharge outlet, a supply pipe or conduit for a non-oxidizing gas for the pneumatic transport is provided at the transport conduit, and an apparatus in a heat-resistant structure, or a cooling structure or an apparatus in a dust-cooling structure is provided at a destination point of the pneumatic transport by the transport conduit.

When dust is discharged from the dry type dust collector, the atmospheric air invades by at least a substitution or displacement volume corresponding to the volume of discharged dust into the dry type dust collector by suction.

One idea to prevent suction is to separately introduce a non-oxidizing gas by at least an equivalent volume into the dry type dust collector. When the open port area is large, the atmospheric air invades into the dry type dust collector by natural convection. To prevent such invasion, it is necessary to increase the amount of non-oxidizing gas that is introduced and to maintain the discharging of non-oxidizing gas from the open port. The present vacuum/reduced pressure refining process (A) is based on this idea as shown, for example, in FIG. 6.

Alternatively, the invading atmospheric air can be replaced with non-oxidizing gas for the air. Specifically, a non-oxidizing gas atmosphere is made dominant at the outside of the dust discharge outlet. The present vacuum/reduced pressure refining process (B) is based on such an alternative. A suitable facility for carrying out this vacuum/reduced pressure refining process is the present vacuum/reduced pressure refining facility.

It is an object of the present invention to prevent air invasion into the dry type dust collector during the dust discharging period and also to prevent oxidation of dust by air, and thus the non-oxidizing gas atmosphere should be dominant in the dry type dust collector before the start of dust discharge.

Figure 6:
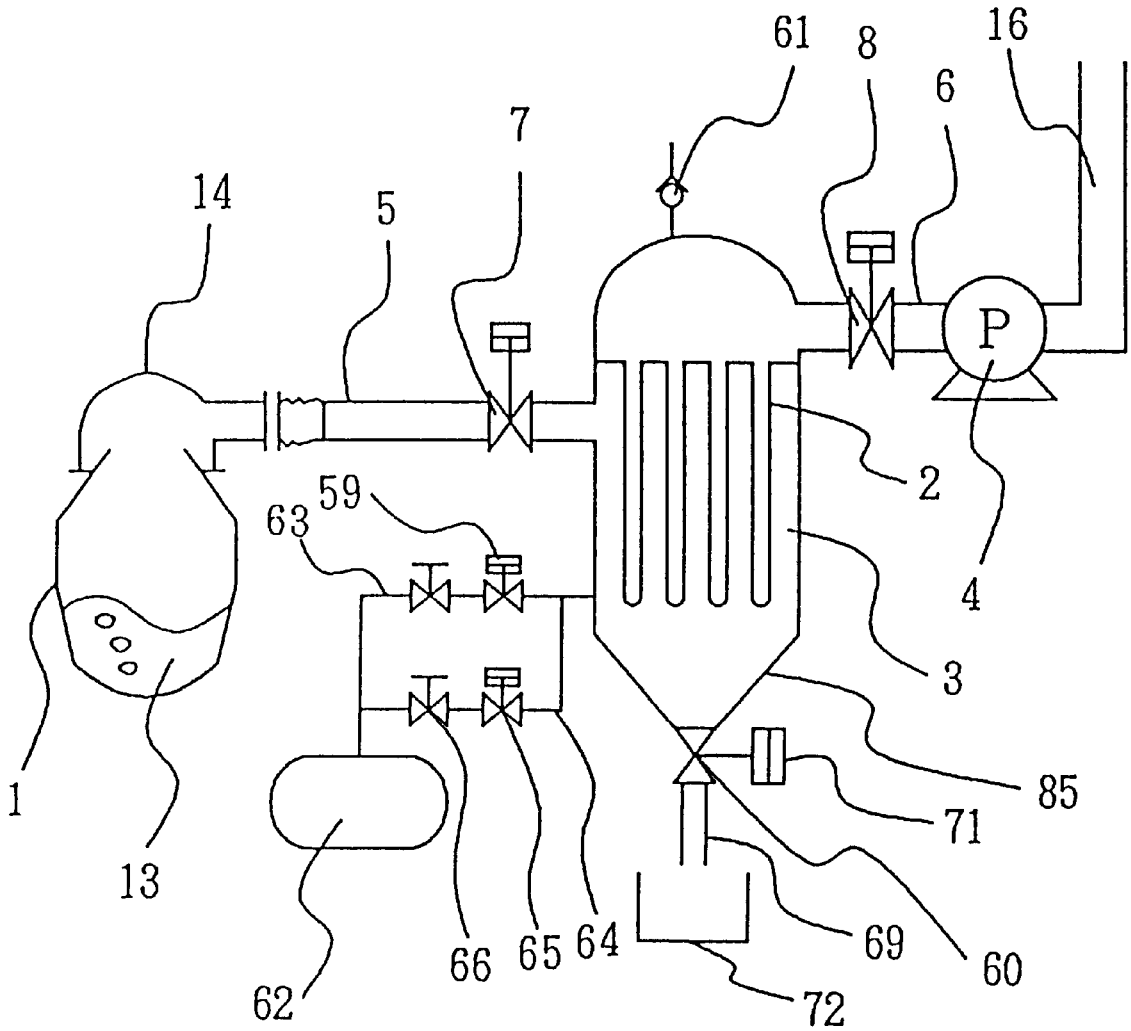
FIG. 6 is a view showing a further embodiment of a vacuum/reduced pressure refining facility for carrying out the present vacuum/reduced pressure refining process A.

For example, filter 2 and evacuating apparatus 4 of the dry type duct collector, shown in FIG. 6, have the same meanings as previously defined.

Further, dust discharge outlet 69 has the same meaning as that of dust discharge outlet 39 as previously mentioned. Also, non-oxidizing gas has the same meaning as previously defined.

An example of a method for introducing the non-oxidizing gas is shown in FIG. 6. Special piping 64 for introducing the non-oxidizing gas from gas holder 62 during the dust discharging period may be used, or gas introduction piping 63 for returning the pressure or pipings for other purposes may be used. Also, since such non-oxidizing gas should not be introduced during the period of vacuum/reduced pressure refining treatment, it is essential to provide an opening/closing valve 65 in special piping 64 for introducing the non-oxidizing gas. To adjust a proper amount of the injection gas to satisfy both function and cost at the same time, it is preferable to provide flow rate control valve 66 in special piping 64 for introducing the non-oxidizing gas.

The flow rate of the non-oxidizing gas to be introduced depends on the structure of the dust discharge outlet 69, the properties and amount of dust and the overall size and structure of the dry type duct collector 3. To substantially prevent air suction or convection invasion through dust discharge outlet 69, the non-oxidizing gas, must be introduced into dry type dust collector 3 to such a degree as to allow the non-oxidizing gas to flow out of dust discharge outlet 69. Specifically, the flow rate must be determined and adjusted based on trial runs, etc.

The most preferable period for introducing the non-oxidizing gas into the dry type dust collector 3 is the period from just before starting to open the dust discharge outlet 69 to discharge dust into dust receiving box 72 until the dust discharge outlet is closed after the completion of dust discharging. The gas introduction can be started/discontinued at the same time as opening/closing the dust discharge outlet, depending on such conditions as the size of the dust discharge outlet, the opening/closing speed, etc.

According to the present vacuum/reduced pressure refining process (B), the non-oxidizing gas atmosphere must be kept dominant at the outside of the dust discharge outlet. The gas atmosphere is sufficiently dominant, if the oxygen concentration can be controlled to a few percent or less.

Thus, it is not necessary to attain strict sealing of the apparatus as in the vacuum sealing, and it is sufficient, if the non-oxidizing gas atmosphere can be substantially maintained. A coverage of the non-oxidizing gas atmosphere may be such that the above-mentioned oxygen concentration can be maintained just outside the dust discharge outlet so as not to allow the air to leak into the dust collector by suction through the dust discharge outlet. The necessary period of maintaining the non-oxidizing gas atmosphere is the same period as for introducing the non-oxidizing gas into the dry type dust collector according to the above-mentioned vacuum/reduced pressure refining process (A).

For example, the present vacuum/reduced pressure refining process C is a process for carrying out the present vacuum/reduced pressure refining processes A and B at the same time.

Figure 7:
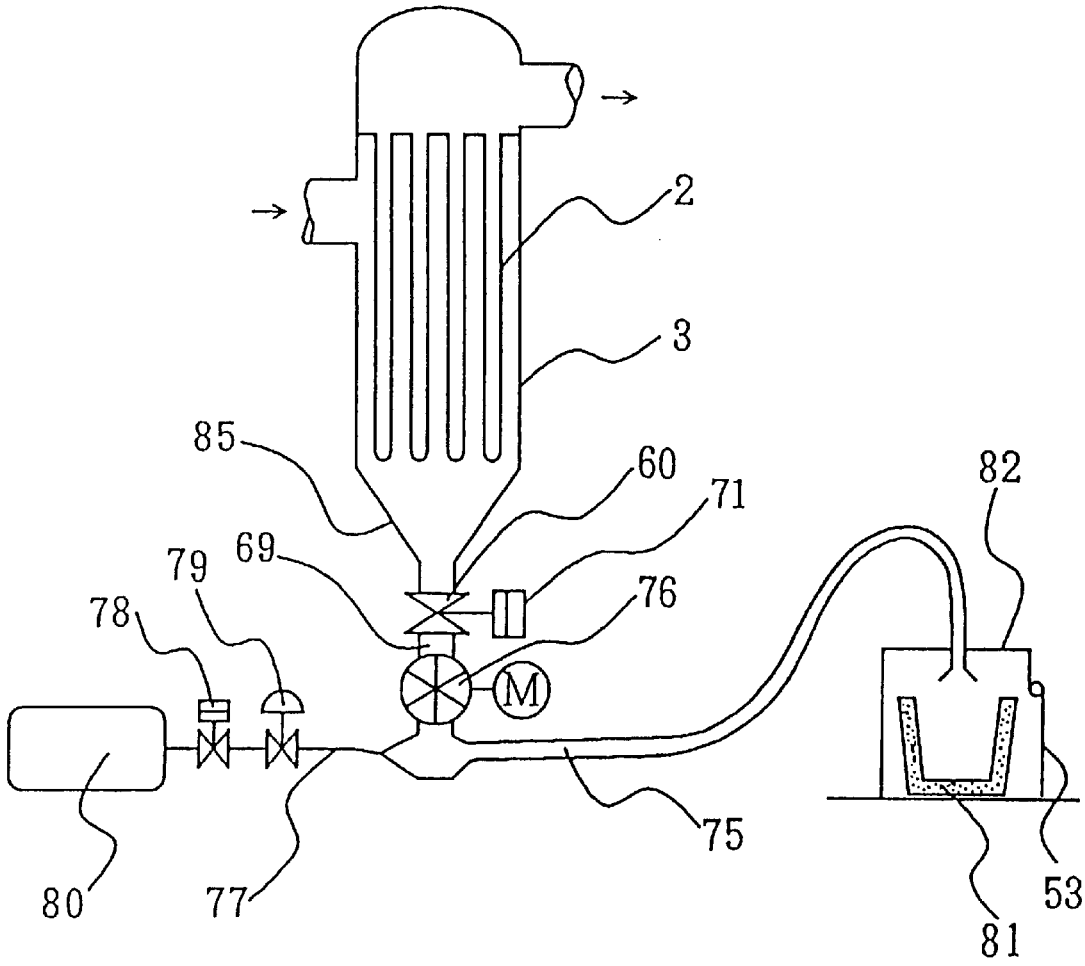
FIG. 7 is a view showing a still further embodiment of a vacuum/reduced pressure refining facility for carrying out the present vacuum/reduced pressure refining process B.

An example of the present vacuum/reduced pressure refining facility suitable for carrying out the present vacuum/reduced pressure refining process B is shown in FIG. 7.

First of all, transport piping 75 for pneumatically transporting discharged dust is hermetically connected to the outside of dust discharge outlet 69. If not hermetically connected air invasion will take place and the non-oxidizing gas atmosphere cannot be kept dominant at the outside of dust discharge outlet 69, and thereby a failure to prevent contact of dust with air occurs, resulting in heat generation, and air suction into the dry type dust collector resulting in trouble. So long as the hermetic connection can be attained, a discharge auxiliary apparatus such as rotary valve 76 etc. can be provided between dust discharge outlet 69 and transport piping 75.

The transport piping 75 is provided with supply piping 77 for introducing the non-oxidizing gas for pneumatically transporting dust. By introducing the non-oxidizing gas through supply piping 77, dust can be pneumatically transported, while keeping the non-oxidizing gas atmosphere dominant at the outside of dust discharge outlet 69. When an oxidizing gas such as air, etc. is used as a gas for pneumatic transport, air invades the dry type dust collector 3 through dust discharge outlet 69 and damages filter 2, thereby causing heat damage/deterioration of devices such as packings, etc. near dust discharge outlet 69 or causing discharge trouble due to dust sintering or agglomeration. Furthermore, pneumatic transport trouble, due to piping damage/deterioration caused by dust heat generation in transport piping 75 and plugging due to sintering or agglomeration of dust, takes place.

Further, an apparatus 81 in a heat-resistant structure 82 or cooling structure or an apparatus in a dust-cooling structure must be provided at a destination point of pneumatic transport by transport piping 75. The dust, when pneumatically transported by the non-oxidizing gas after returning the pressure by the non-oxidizing gas, is released from transport piping 75 at the destination point of pneumatic transport and brought into contact with oxygen in the air.

When the dust contains fine metal powders in an unoxidized metallic state such as Mg, Mn, etc., heat generation takes place. Thus, it is essential that the apparatus at the destination point of the pneumatic transport is in such a structure as not to cause damage to the apparatus even if the dust undergoes strong heat generation. In other words, when the apparatus at the destination point of pneumatic transport is a secondary dust collector using filter cloth, the filter cloth may be burnt due to heat generation of dust in some cases.

Specific examples of the apparatuses 81, 82 at the destination point of the pneumatic transport include apparatuses in a heat-resistant structure, such as a refractory-lined dust pot, a refractory-lined dust-collecting duct, etc., apparatuses in a cooling structure such as a water-cooled dust-collecting duct, a gas cooler, a water-cooled cyclone separator, etc., and apparatuses in a structure enabling direct cooling of dust per se such as a water tank, a dust-collecting duct through which passes an ordinary temperature gas having a heat capacity large enough in relation to the quantity of heat generated by the pneumatically transported dust, etc.

Furthermore, it is desirable from the viewpoint of cost to pass the non-oxidizing gas only during the period of pneumatically transporting the dust, and thus it is desirable to provide opening/closing valve 78 in the supply piping for introducing the non-oxidizing gas for pneumatic transport. Furthermore, to establish suitable conditions for pneumatically transporting the dust, it is desirable to provide a pressure control device and flow rate control device 79 in supply line 77 for introducing the non-oxidizing gas for pneumatic transport.

Examples of facilities capable of carrying out the present vacuum/reduced pressure refining process B, other than the present vacuum/reduced pressure refining facility as shown in FIGS. 6 and 7, include those shown in FIGS. 4 and 5, where the flow rate of the non-oxidizing gas, for example, Ar, is not the same.

Next, the fourth embodiment of the present invention will be described.

The period from the end of pressure returning to the start of next treatment is the so called waiting period, during which the atmospheric air invades in the case of a negative pressure (pressure lower than the atmospheric pressure), even if the dry type dust collector is not in operation, and the oxygen in the atmospheric air may react with metals remaining in the system, as attached, to oxidize the metals, resulting in damage to the filter and other devices near the dust-remaining positions, for example, the vacuum valve, vacuum seal packings, etc. at the port for discharging dusts. Remaining dust is likely to cause a failure in hermetically closing the seal part of the block valve due to the presence of dust and deteriorate the vacuum seal more often than usual due to the attrition of seal members by the dust. Even if the connection ports of the upstream/downstream block valves, dust-transporting devices or the like are fully closed, it is industrially difficult to maintain a completely hermetically closed state. Furthermore, the temperature of the dust collector and internal structures decrease in the waiting period after the treatment end as compared with the treatment period, and the volume of the filled non-oxidizing gas is reduced at the time of pressure returning. To compensate, it is necessary to continuously or intermittently inject the non-oxidizing gas such as a nitrogen gas, an argon gas, etc. into the dust collector to suppress an increase in oxygen concentration due to the leakage through the valves.

The flow rate of the gas to be injected is sufficient, if the flow rate can maintain the inside of the dust collector under a superatmospheric pressure, i.e. the so-called positive pressure, and should be determined in view of the structure and capacity of the individual apparatuses and devices and leakage through the valves. A higher flow rate is not a problem with respect to the object of the present invention, so long as the flow rate can provide a positive pressure, but is useless from the view point of cost.

Specifically, as shown in FIG. 6, the non-oxidizing gas is injected into the dry type dust collector 3 during the waiting period following the return of the pressure to a positive pressure, using non-oxidizing gas injection piping 64 for injecting a non-oxidizing gas such as a nitrogen gas, an argon gas, etc. to dry type dust collector 3, opening/closing valve 65 and manual or automatic flow rate control valve 66 for adjusting the flow rate to a necessary one. It is preferable to use piping and opening/closing valve other than those for pressure returning, as shown in FIG. 6, but gas-introducing piping 63 for use in injection of a non-oxidizing gas such as a nitrogen gas, and argon gas, etc. during the pressure-returning period may be used to achieve this effect.

For the other piping, it is preferable that dry type dust collector 3 is provided with a non-oxidizing gas injection piping 64 with opening/closing valve 65 having a non-electrical/non-pneumatic opening function to open/close the valve freely. Also provided is flow rate control valve 66, and safety valve 61 capable of opening when the inside of the dry type dust collector 3 is subjected to a superatmospheric pressure. A gas introduction piping 63 is provided for pressure returning by closing freely opening/closing block valve 7, provided in upstream duct 5 for connecting vacuum/reduced pressure refining vessel 1 to dry type dust collector 3, and freely opening/closing block valve 8 provided in downstream duct 6 for connecting dry type dust collector 3 to reduced pressure evacuating apparatus 4. Note, the dry type dust collector 3 includes dust discharge ball valve 60, which is operated by actuator 71.

The first reason for the preference of providing the other piping is to design the non-oxidizing gas injection piping 64 in a control system that is effectively capable of automatically opening at an uncontrollable time, i.e. in the so called non-electrically/non-pneumatically open state. Whereas opening/closing valve 59 for pressure returning is usually designed in a control circuit so as to attain-automatic closing, i.e. the so-called non-electrically/non-pneumatically closed state at an uncontrollable time such as an electric power failure, interruption of driving compressed air supply, etc. to prevent trouble such as excessively high returned pressure, etc. The term "non-electrically/non-pneumatically open" is used broadly to mean an "emergency opening" design for opening the valve by a spring force, etc. at any uncontrollable time caused not always by interruption of the electric power/compressed air supply.

The second reason is to use a low flow rate, such as not more than 1 $Nm^3$/min. at a maximum, for providing a positive pressure during the waiting period, whereas in the case of pressure returning, a high flow rate, such as a several tens $Nm^3$/min, must be used because the pressure returning must be carried out usually in a short time such as less than a few minutes. Thus, when one piping is used, it is inevitable to set two flow rates in the flow rate control valve, etc., and it is usually difficult to obtain a flow rate control valve capable of controlling the flow rate in a broad ratio ranging from 1 to more than several tens.

Furthermore, in the embodiment of FIG. 6, the inside of the dry type dust collector 3 is kept under a positive pressure in a nitrogen gas atmosphere by providing safety valve 61 which is set to a little higher discharge pressure than the atmospheric pressure on the dry type dust collector 3 and by continuously injecting a non-oxidizing gas therein at a flow rate to an excessive degree during the waiting period. Positive pressure can be maintained by manipulating opening/closing valve 65 in non-oxidizing gas injection piping 64 in accordance with values indicated by a pressure-detecting device in the dry type duct collector 3 and intermittently injecting the gas so as to keep the inside of the dry type dust collector 3 neither under a negative pressure nor under an excessive positive pressure, but to this effect it is desirable to provide a backup device capable of continuously maintaining a positive pressure even in the event of an electric power failure, etc.

EXAMPLES

First of all, description will be made below, referring to Examples according to the first embodiment of the present invention.

A specific example will be given by operating results of oxidation/reduction refining of molten steel containing slags in the vacuum/reduced pressure refining vessel 1 having a 60-ton capacity shown in FIG. 1. A Tetron-made filter having an ordinary heat-resistant temperature of 130° C. was used for filter 2. Filter damage was checked, not by visual observation after every vacuum/reduced pressure refining treatment, but by judging the soundness of the filter by way of filter pressure loss measured at positions before and after the filter, suspended solids, PH, etc. of effluent water from a condenser (not shown in the drawing) of downstream reduced pressure evacuating apparatus 4, and filter 2.

Example 1

After connection of expansion joint 9 was completed at the start of vacuum/reduced pressure refining treatment, block valve 7 in the upstream duct 5 was opened. Before opening block valve 7, reduced pressure evacuating apparatus 4 was operated and downstream block valve 8 was opened. As a result, the filter was found sound for the plain steel, but damaged at the start of the next vacuum/reduced pressure refining treatment after high Mn steel treatment in the case of high Mn steel.

Example 2

At the start of vacuum/reduced refining treatment, a nitrogen gas from non-oxidizing gas supply 12 was introduced through piping 10 for 60 seconds and then expansion joint 9 was connected. After the end of the connection operation, block valve 7 in upstream duct 5 was opened. However, before opening block valve 7, reduced pressure evacuating apparatus 4 was operated and downstream block valve 8 was opened. As a result, the filter was not damaged at all.

Example 3

At the time of ending the last vacuum/reduced pressure refining treatment, the pressure at the upstream side of block-valve 7 in upstream duct 5 was returned with a nitrogen gas by utilizing piping 10 and furnace bottom injection. At the start of the present vacuum/reduced pressure refining treatment, the operation was carried out in the same manner as in Example 1. As a result, the filter was not damaged during the period of continuous treatment, however it was damaged during the period of treatment following a waiting period of 2 hours.

Example 4

In Example 3, the open port of expansion joint 9 was closed with a seal lid throughout the waiting period. As a result, the filter was not damaged, irrespective of the duration of the waiting period.

Example 5

In Example 3, a nitrogen gas was injected from piping 10 for 30 seconds at the start of the present vacuum/reduced pressure refining treatment. As a result, the filter was not damaged during the period of continuous treatment, but the filter was damaged during the period of treatment following a waiting period of 8 hours.

Example 6

In Example 4, nitrogen gas was injected from piping 10 for 20 seconds at the start of the present vacuum/reduced pressure refining treatment. As a result, the filter was not damaged, irrespective of the duration of the waiting period, including the case of high Mn steel.

Comparative Example 1

At the start of vacuum/reduced pressure refining treatment, reduced pressure evacuating apparatus 4 was operated, and then block valve 7 was opened to introduce the gas into dust collector 3. These operations were carried out before the end of connecting expansion joint 9. As a result, the filter was damaged by burning during the period of 6th treatment.

Next, description will be made below with reference to an Example according to the second embodiment of the present invention.

Example 7

The present invention was applied to oxidation/reduction refining of molten steel containing slags in vacuum/reduced pressure refining furnace 1 having a capacity of 60 tons as shown in FIG. 4. The dry type duct collector 3 used filter cloth of Tetron having an ordinary heat-resistant temperature of 130° C. as filter 2.

A pneumatically driven vacuum ball valve was used as vacuum seal valve 30 at port 39 for discharging dust from dry type dust collector 3. Following each end of pressure returning after the vacuum/reduced pressure refining, the vacuum seal ball valve 30 was opened to discharge the dust.

Initially, the bottom side of vacuum seal valve 30 was open to the atmospheric air and only dust receiving box 42 was provided below the valve, as shown in FIG. 11 as a comparative example. As a result, heat was generated in conical region 55 at the lower part of dry type dust collector 3 during the vacuum evacuating period, and dust was sintered in conical region 55 in three runs of a total of 20 runs. It was impossible to discharge the dust after the treatment, and holes of small bean size were made through the filter cloth.

Then, sealing enclosure 54 was provided below vacuum seal valve 30 as shown in FIG. 4, and the inside of sealing enclosure 54 was flushed with a nitrogen gas. Then, the vacuum/reduced pressure refining process was carried out. The oxygen concentration in sealing enclosure 54 was measured by an oxygen concentration meter and the nitrogen gas flow rate was set so as to maintain an oxygen concentration of not more than about 2%. As a result, neither heat generation in conical region 55 during the vacuum evacuating period or failure to discharge dust after the treatment was found in a total 50 runs.

Furthermore, rotary valve 46 was provided below vacuum seal valve 30 and piping 47 for supplying nitrogen gas through short piping 39, that connects the vacuum seal valve to the rotary valve, as shown in FIG. 5. Nitrogen gas was passed through piping 47 at a flow rate of 0.3 $Nm^3$/min during the vacuum evacuating period. As a result, neither heat generation in conical region 55 during the vacuum evacuating period or failure to discharge dust after the treatment was found in a total 103 runs.

Next, description will be made below, with reference to Examples according to the third embodiment of the present invention.

Examples 8 to 11

The present invention was applied to oxidation/reduction refining of molten steel containing slags in a vacuum/reduced pressure refining furnace having a capacity of 60 tons. Filter cloth of Tetron having an ordinary heat-resistant temperature of 130° C. was used as the filter. Damage to the filter cloth was checked after the operation after a specific duration of time. Dust discharging was carried out each time after the end of pressure returning after vacuum/reduced pressure refining.

Example 8

The present vacuum/reduced pressure refining process A was carried out in a vacuum/reduced pressure refining facility, as shown in FIG. 6 by injecting a nitrogen gas at a flow rate of 2 $Nm^3$/min into a dry type dust collector 3 during the dust discharging period. As a result, heat generation occurred in conical region 85 at the lower part of the dry type dust collector 3 only in 3 runs out of a total of 50 runs during the dust discharging period. However, neither dust remaining or failure to open/close ball valve 60 for discharging the dusts, etc. took place, and the filter cloth was also found in a sound condition.

Example 9

The present vacuum/reduced pressure refining process B was carried out in a vacuum/reduced pressure refining facility as shown in FIG. 4 by sealing the direct outside of dust discharge outlet 39 during the dust discharging period with a nitrogen gas, thereby obtaining an oxygen concentration=1.5%. As a result, heat generation occurred in conical region 55 at the lower part of dry type dust collector 3 only in one run of a total of 63 runs during the dust discharging period. However, neither dust remaining or a failure to open or close-ball valve 30 for discharging the dust, etc. took place, and the filter cloth was also found in a sound condition.

Example 10

The present vacuum/reduced pressure refining process C was carried out in a vacuum/reduced pressure refining facility, as shown in FIG. 4, by providing the same sealing enclosure 54 and non-oxidizing gas supply piping 47 at the lower part of dust discharge outlet 39 of the vacuum/reduced pressure refining facility as shown in FIG. 4. The process of carrying out nitrogen gas injection into dry type dust collector 3 under the same conditions as in Example 8 and nitrogen gas sealing directly outside of dust discharge outlet 39 under the same conditions as in Example 9 occurred at the same time. As a result, no heat generation, dust remaining, failure to open or close ball valve 30 for discharging the dust, etc. took place, and the filter cloth was also found in a sound condition.

Comparative Example 2

In the vacuum/reduced pressure refining facility as shown in FIG. 6, neither nitrogen gas injection into the dry type dust collector 3 during the dust discharging period or maintenance of non-oxidizing gas atmosphere directly outside of the dust discharge outlet 69 was carried out. As a result, heat generation occurred in conical region 85 at the lower part of the dry type dust collector 3. Heat generation occurred in 13 runs of a total of 20 runs during the dust discharging period, and in two runs of which ball valve 60 for discharging the dusts underwent seizure and a failure to close the valve took place. The dust remaining due to sintering and agglomeration partly took place and holes of small bean size were made through the filter cloth after 20 runs of heat treatment.

Example 11

In the present vacuum/reduced pressure refining facility as shown in FIG. 7, dust was pneumatically transported with a nitrogen gas supplied from non-oxidizing gas holder 80. As a result, no heat generation occurred at all in conical region 85 and transport piping 75 and no failure to open or close ball valve 60 for discharging the dust was observed.

Comparative Example 3

A compressor was connected to supply piping 77 of the present vacuum/reduced pressure refining facility as shown in FIG. 7 to pneumatically transport dust by air pressure. As a result, heat generation occurred in transport piping 75 in 4 runs of a total of 10 runs, and in two runs a failure to catch the dust with rotary valve 76 and a failure to discharge the dust from rotary valve 76 were observed.

Next, description will be made below, with reference to an Example according to the fourth embodiment of the present invention.

Example 12

A specific example will be given below, referring to operating results of the oxidation/reduction refining of molten metal containing slags in vacuum/reduced pressure refining vessel 1 having a capacity of 60 tons, as shown in FIG. 6. Filter cloth of Tetron, having an ordinary heat-resistant temperature of 130°, was used as a filter. Damage to the filter was checked after a specific period.

Results of oxygen concentration measurement in the dry type dust collector 3 in the Example based on nitrogen gas injection during the waiting time according to the present invention and in a Comparative Example without the injection are shown in Table 1. In Table 2, filter damage after the operation and the dust discharging state during the operating period are shown. It is evident therefrom that the Example shows neither filter damage or failure to discharge the dust.

TABLE 1

| | Just after pressure returning | 1 hr there-after | 6 hr there-after | 24 hr there-after | Remarks |
|---|---|---|---|---|---|
| Example | 0.4% | 0.5% | 0.6% | 0.5% | Nitrogen injection rate: 0.5 $Nm^3$/min |
| Comp. Ex. | 0.4% | 1.2% | 4.5% | 12.3% | Nitrogen injection rate: 0 $Nm^3$/min |

TABLE 2

| | Filter damage | Dust discharging state |
|---|---|---|
| Example | Filter was sound after 120 runs of heat treatment | No dust bridging (*2) was found at the lower part of dust collector and ball valve (*1) |
| Comparative Example | Many holes of small bean sizes were made after 103 runs of heat treatments | Heat generation and failure to discharge the dust occurred at the lower part of dust collector and ball valve in 14 runs |

*1 "Ball valve" refers to e.g. "30" in FIG. 4 (for vacuum sealing of dust discharge outlet)

*2 "Dust bridging" refers to a state in which dust has fallen down from the filter and accumulated, e.g. in conical region 55 at the lower part of dust collector as shown in FIG. 5, and coagulates by oxidation and heat generation to form "bridges", thereby failing to undergo further discharge or falling.

By application of the above-mentioned four (4) embodiments in combination, a stable technique of using vacuum dry type dust collection with a filter throughout all phases of treatment, dust scraping and transport and protection against atmospheric air invasion can be established.

Effects of the invention according to the first embodiment of the Invention:

According to the present invention, combustible filters such as filer cloth, etc., when used in a dust collector, will not be damaged, or burnt, and thus the use of expensive high temperature-enduring filters, ceramic-filters, etc. of highly restricted use conditions are not necessary. Low cost, non-ceramic (combustible) filters can be used in this embodiment. Even if non-combustible filters, such as high temperature-enduring filters or ceramic filters are used, the problem of dust sintering on the filter surface can be eliminated thereby preventing a reduction in filterability (gas permeation) of the filters due to clogging.

Effects of the invention according to the second embodiment of the Invention:

According to the present invention, inconvenience due to burning and hole penetration in the ease of filters of the filter cloth type, clogging in the case of ceramic filters, heat generation and damage of devices relating to the dust discharge port at the lower part of dry type dust collector, and air oxidation of dust such as dust sintering and failure to discharge the dust in the dry type dust collector, can be prevented to enable safe use of a dry type duct collector having a filter in the vacuum/reduced pressure refining.

Effects of the invention according to the third embodiment of the Invention:

According to the present invention, a dry type dust collector with a filter can be used in the vacuum/reduced pressure refining without inconveniences such as filter damage during the period of discharging-dust from the dry type dust collector, damage of devices near the dust discharge outlet, heat generation damage and plugging of transport piping and heat damage of apparatuses located at the destination position of pneumatic transport of dust.

Effects of the invention according to the fourth embodiment of the Invention:

According to the present invention, combustible filters such as filter cloth, etc. even when used in a dry type dust collector, never experience damaging, burning, etc., and thus the use of expensive high temperature resistant filter cloth, ceramic filters, etc. of scripted use conditions are not necessary, and the use of low-cost, non-ceramic (combustible) filters is possible. Even if non-combustible filters such as high temperature-resistant filter cloth or ceramic filters are used, any reduction in filterability due to clogging of filter surfaces caused by dust sintering can be prevented, and also dust discharge trouble at the dust discharge outlet due to dust sintering can be prevented.

What is claimed is:

1. A vacuum/reduced pressure refining process using a vacuum/reduced pressure refining facility including a vacuum/reduced pressure refining vessel, a dry dust collector having a filter, a reduced pressure evacuating apparatus, an upstream duct connecting the vacuum/reduced pressure refining vessel and the dry dust collector, a freely opening/closing block valve disposed in the upstream duct, and a downstream duct connecting the dry dust collector and the reduced pressure evacuating apparatus, said vacuum/reduced pressure refining process comprising:

closing a connection port of the vacuum/reduced pressure refining vessel prior to a start of a vacuum/reduced pressure refining treatment;

establishing a hermetically closed state in the vacuum/reduced pressure refining facility from the vacuum/reduced pressure refining vessel to the block valve in the upstream duct;

opening the block valve in the upstream duct after the hermetically closed state is established; and bringing the dust collector into operation.

2. A vacuum/reduced pressure refining process as claimed in claim 1, wherein the dust collector is brought into operation by:

starting the evacuating apparatus; and opening a block valve provided in the downstream duct, wherein the block valve in the downstream duct is opened before the block valve in the upstream duct is opened.

3. A vacuum/reduced pressure refining process as claimed in claim 1, wherein the dust collector is brought into operation by:

starting the evacuating apparatus; and opening a block valve provided in the downstream duct, wherein the block valve in the downstream duct is opened at the same time as the block valve in the upstream duct is opened.

4. A vacuum/reduced pressure refining process as claimed in claim 1, further comprising:

injecting a non-oxidizing gas into the upstream duct at the start of the vacuum/reduced pressure refining treatment prior to closing the connection port, wherein the connection port is closed after the oxygen concentration in the upstream duct has been substantially reduced to zero.

5. A vacuum/reduced pressure refining process as claimed in claim 4, further comprising:

closing the block valve provided in the upstream duct at the end of a vacuum/pressure refining treatment;

opening the connection port after the block valve in the upstream duct has been closed; and injecting a non-oxidizing gas into the upstream duct at a location that is upstream of the block valve in the upstream duct in order to return the pressure of the atmosphere in the upstream duct to ambient atmospheric pressure.

6. A vacuum/reduced pressure refining process as claimed in claim 5, further comprising:

closing an open port of a connection apparatus that is connected to an end of the upstream duct that is nearest to the vacuum/reduced pressure refining vessel; and maintaining the port of the connection apparatus in a closed position during a waiting period from the end of the vacuum/reduced pressure refining treatment to a start of the next treatment.

7. A vacuum/reduced pressure refining process as claimed in claim 4, wherein the non-oxidizing gas is injected at a location that is near to the block valve in the upstream duct.

8. A vacuum/reduced pressure refining process as claimed in claim 4, wherein the non-oxidizing gas is injected at a plurality of locations upstream of the block valve in the upstream duct.

9. A vacuum/reduced pressure refining process as claimed in claim 1, further comprising:

closing the block valve provided in the upstream duct at the end of a vacuum/pressure refining treatment; and opening the connection port after the block valve in the upstream duct has been closed.

10. A vacuum/reduced pressure refining process as claimed in claim 9, further comprising:

closing an open port of a connection apparatus that is connected to an end of the upstream duct that is nearest to the vacuum/reduced pressure refining vessel; and maintaining the port of the connection apparatus in a closed position during a waiting period from the end of the vacuum/reduced pressure refining treatment to a start of the next treatment.

11. A vacuum/reduced pressure refining process as claimed in claim 2, further comprising:

closing the block valve provided in the upstream duct at the end of a vacuum/pressure refining treatment; and opening the connection port after the block valve in the upstream duct has been closed.

12. A vacuum/reduced pressure refining process as claimed in claim 3, further comprising:

closing the block valve provided in the upstream duct at the end of a vacuum/pressure refining treatment; and opening the connection port after the block valve in the upstream duct has been closed.

13. A vacuum/reduced pressure refining process as claimed in claim 1, further comprising:

closing the block valve provided in the upstream duct at the end of a vacuum/pressure refining treatment; and opening the connection port after the block valve in the upstream duct has been closed.

14. A vacuum/reduced pressure refining process as claimed in claim 13, further comprising:

closing an open port of a connection apparatus that is connected to an end of the upstream duct that is nearest to the vacuum/reduced pressure refining vessel; and maintaining the port of the connection apparatus in a closed position during a waiting period from the end of the vacuum/reduced pressure refining treatment to a start of the next treatment.

15. A vacuum/reduced pressure refining process as claimed in claim 5, wherein the non-oxidizing gas is injected at a location that is near to the block valve in the upstream duct.

16. A vacuum/reduced pressure refining process as claimed in claim 5, wherein the non-oxidizing gas is injected at a plurality of locations upstream of the block valve in the upstream duct.

17. A vacuum/reduced pressure refining process as claimed in claim 1, further comprising:

closing the block valve provided in the upstream duct at the end of a vacuum/pressure refining treatment;

opening the connection port after the block valve in the upstream duct has been closed; and injecting a non-oxidizing gas into the upstream duct at a location that is upstream of the block valve in the upstream duct in order to return the pressure of the atmosphere in the upstream duct to ambient atmospheric pressure.

18. A vacuum/reduced pressure refining process as claimed in claim 9, further comprising:

closing an open port of a connection apparatus that is connected to an end of the upstream duct that is nearest to the vacuum/reduced pressure refining vessel; and maintaining the port of the connection apparatus in a closed position during a waiting period from the end of the vacuum/reduced pressure refining treatment to a start of the next treatment.

19. A vacuum/reduced pressure refining process as claimed in claim 17, wherein e non-oxidizing gas is injected at a location that is near to the block valve in the upstream duct.

20. A vacuum/reduced pressure refining process as claimed in claim 17, wherein he non-oxidizing gas is injected at a plurality of locations upstream of the block valve in the upstream duct.

21. A vacuum/reduced pressure refining process using a vacuum/reduced pressure refining facility comprising at least a vacuum/reduced pressure refining furnace, a dry dust collector using a filter, and an evacuating apparatus, said vacuum/reduced pressure refining process comprising:

sealing an outside of a vacuum seal valve or a vacuum seal lid, located at a bottom dust discharge portion of the dry dust collector, with a non-oxidizing gas during a period in which the dry dust collector is maintained under a reduced pressure that is below the ambient atmospheric pressure.

22. A vacuum/reduced pressure refining process using a vacuum/reduced pressure refining facility comprising at least a vacuum/reduced pressure refining furnace, a dry dust collector having a filter and a freely opening/closing dust discharge outlet located at a bottom of the dry dust collector, an evacuating apparatus, a pipe for introducing a non-oxidizing gas into the dust collector, and an opening/closing valve in the pipe, said vacuum/reduced pressure refining process comprising:

introducing non-oxidizing gas into the dust collector so as to allow the non-oxidizing gas to flow out of the dust discharge outlet when dust is to be discharged from the dust discharge outlet during an off-period from a vacuum/reduced pressure treatment.

23. A vacuum/reduced pressure refining process using a vacuum/reduced pressure refining facility comprising at least a vacuum/reduced pressure refining furnace, a dry dust collector using a filter and having a freely opening/closing dust discharge outlet located at a bottom of the dry type dust collector, and an evacuating apparatus, said vacuum/reduced pressure refining process comprising:

maintaining an outside of the dust discharge outlet in a non-oxidizing gas atmosphere when dust is to be discharged from the dust discharge outlet during an off-period of a vacuum/reduced pressure treatment.

24. A vacuum/reduced pressure refining process using a vacuum/reduced pressure refining facility comprising at least a vacuum/reduced pressure refining furnace, a dry dust collector using a filter and having a freely opening/closing dust discharge outlet at a bottom of the dry dust collector, an evacuating apparatus communicating with the dry dust collector, and a pipe for introducing a non-oxidizing gas into the dry dust collector, and an opening/closing valve in the pipe, said vacuum/reduced pressure refining process comprising:

introducing a non-oxidizing gas into the dry dust collector so as to allow the non-oxidizing gas to flow out of the dust discharge outlet when dust is to be discharged from the dust discharge outlet during an off-period from a vacuum/reduced pressure refining treatment; and maintaining an area outside of the dust discharge outlet in a non-oxidizing gas atmosphere at the same time as the non-oxidizing gas is introduced into the dry dust collector.

25. A vacuum/reduced pressure refining process using a vacuum/reduced pressure refining facility comprising a vacuum/reduced pressure refining vessel, a dry dust collector using a filter, an upstream duct connecting the vacuum/reduced pressure refining vessel and the dry dust collector, a reduced pressure evacuating apparatus, and a downstream duct connecting the dry dust collector and the reduced pressure evacuating apparatus, said vacuum/reduced pressure refining process comprising:

closing a first freely opening/closing block valve provided in the upstream duct;

closing a second freely opening/closing block valve provided in the downstream duct, wherein the second block valve is closed at the same time as the first block valve is closed; and injecting a non-oxidizing gas into the dry dust collector in order to maintain a superatmospheric pressure in the dry dust collector during a waiting period in which the dry type dust collector does not operate, the waiting period running from the time of completion of a pressure returning operation until the start of a next operation of the dry dust collector.

26. A vacuum/reduced pressure refining facility comprising:

a vacuum/reduced pressure refining vessel;

a dry dust collector having a filter;

an upstream duct connecting said vacuum/reduced pressure refining vessel and said dry dust collector;

a reduced pressure evacuating apparatus;

a downstream duct connecting said dry dust collector and said reduced pressure evacuating apparatus;

a freely opening/closing block valve provided in said upstream duct;

a pipe for introducing a non-oxidizing gas into said upstream duct, said pipe communicating with said upstream duct from a location that is upstream of said block valve; and an opening/closing valve provided in said pipe.

27. A vacuum/reduced pressure refining apparatus comprising:

a vacuum/reduced pressure refining vessel;

a dry dust collector having a filter;

an upstream duct connecting said vacuum/reduced pressure refining vessel and said dry dust collector;

a reduced pressure evacuating apparatus;

a downstream duct connecting said dry dust collector and said reduced pressure evacuating apparatus;

a freely opening/closing block valve provided in said upstream duct; and a detachable sealing lid for selectively opening and closing an open port of said upstream duct, said open port being located at an end of said upstream duct that is nearest said refining vessel and upstream of said block valve.

28. A vacuum/reduced pressure refining facility comprising:

a vacuum/reduced pressure refining furnaces;

a dry dust collector having a filter and a bottom dust discharge port;

a freely opening/closing vacuum seal valve or vacuum seal lid disposed in said bottom dust discharge port;

an evacuating apparatus in communication with said dry dust collector;

a sealing enclosure for substantially shutting off atmospheric air at said dust discharge port, said sealing enclosure having a door for permitting dust to be removed from said sealing enclosure;

a conduit communicating with an interior of said sealing enclosure for introducing a non-oxidizing gas into said sealing enclosure; and an opening/closing valve positioned in said conduit for selectively permitting the introduction of the non-oxidizing gas into said sealing enclosure.

29. A vacuum/reduced pressure refining facility comprising:

a vacuum/reduced pressure refining furnace;

a dry dust collector communicating with said refining furnace, said dry dust collector having a filter and a bottom dust discharge port;

an evacuating apparatus communicating with said dry dust collector;

a vacuum seal valve or a vacuum seal lid positioned in said bottom dust discharge port;

a dust discharge auxiliary apparatus positioned in said bottom dust discharge port downstream of said vacuum seal valve or said vacuum seal lid so as to create a hermetically closed space;

a conduit connected to said bottom dust discharge port between said dust discharge auxiliary apparatus and said vacuum seal valve or said vacuum seal lid; and a valve disposed in said conduit for selectively permitting the introduction of a non-oxidizing gas into the hermetically closed space.

30. A vacuum/reduced pressure refining facility comprising:

a vacuum/reduced pressure refining vessel;

a dry dust collector having a filter and a bottom dust discharge outlet;

an evacuating apparatus communicating with said dry dust collector;

a transport conduit, hermetically connected to said bottom dust discharge outlet, for pneumatically transporting dust discharged through said bottom dust discharge outlet;

a non-oxidizing gas pipe connected to said transport conduit for supplying non-oxidizing gas into said transport conduit such that dust, discharged from said bottom dust discharge outlet, can be pneumatically transported through said transport conduit; and a dust receiving structure positioned at an outlet end of said transport conduit, said dust receiving structure comprising one of a heat resistant structure, a dust cooling structure, and means for directly cooling dust received in the dust receiving structure.

31. A vacuum/reduced pressure refining facility comprising:

a vacuum/reduced pressure refining vessel;

a dry dust collector connected to said vacuum/reduced pressure refining vessel via an upstream duct, said dry dust collector having a filter and a safety valve that can open when an interior pressure of said dry dust collector reaches a superatmospheric pressure;

a first block valve disposed in said upstream duct;

a reduced pressure evacuating apparatus connected to said dry dust collector via a downstream duct;

a second block valve disposed in said downstream duct;

a gas-introducing pipe connected to said dry dust collector; and a non-oxidizing gas injection pipe connected to said dry dust collector, said non-oxidizing gas injection pipe being equipped with an open/close valve and a flow rate control valve, wherein said open/close valve has an automatic opening function that is not electrically or pneumatically operated.

32. A vacuum/reduced pressure refining facility as claimed in claim 31, further comprising a valve provided in said gas-introducing pipe and a gas supply vessel connected to said gas-introducing pipe and said non-oxidizing gas injection pipe.

* * * * *